US006565188B1

(12) United States Patent
Saito

(10) Patent No.: US 6,565,188 B1
(45) Date of Patent: May 20, 2003

(54) CLEANING DEVICE FOR INKJET RECORDING HEAD AND INKJET RECORDING DEVICE INCLUDING THE SAME

(75) Inventor: Hiroyuki Saito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 30 days.

(21) Appl. No.: 09/679,605

(22) Filed: Oct. 5, 2000

(30) Foreign Application Priority Data

Oct. 6, 1999 (JP) ..... 11-286050

(51) Int. Cl.[7] ..... B41J 2/165
(52) U.S. Cl. ..... 347/33
(58) Field of Search ..... 347/33, 22, 23, 347/24, 44, 31, 32

(56) References Cited

U.S. PATENT DOCUMENTS 5,543,826 A * 8/1996 Kuronuma et al. ..... 347/23
5,798,775 A * 8/1998 Takahashi et al. ..... 347/33
5,914,734 A * 6/1999 Rotering et al. ..... 347/28
5,984,452 A * 11/1999 Bekki ..... 347/33
6,109,725 A 8/2000 Saikawa et al. ..... 347/33

* cited by examiner

*Primary Examiner*—Shih-Wen Hsieh
(74) *Attorney, Agent, or Firm*—Fitzpatrick, Cella, Harper & Scinto

(57) ABSTRACT

A cleaning device for an inkjet recording head is provided for unerringly cleaning wiper blades by means of a wiper cleaner. An inkjet recording device is also provided. In the cleaning device, a rib and a canopy are formed on a blade cleaner used to scrape off any foreign matter, such as ink, stuck on the wiper blades. The range of contact of the wiper blades and the blade cleaner when a cleaning operation is started is limited. Accordingly, the canopy limits the range of accumulation of the foreign matter scraped off from the wiper blades.

12 Claims, 26 Drawing Sheets

CLEANING DEVICE FOR INKJET RECORDING HEAD AND INKJET RECORDING DEVICE INCLUDING THE SAME

BACKGROUND OF THE INVENTION

1. Field of the Invention

The present invention relates to a cleaning device for cleaning an inkjet recording head, and to an inkjet recording device including the same.

In addition to being applied to commonly used printers, the present invention may be applied to copying machines, facsimile machines including a communications system, word processors including a printing section, or industrial recording devices combined with various types of processors.

2. Description of the Related Art

Hitherto, recording devices functioning as, for example, printers, copying machines, or facsimile machines, or recording devices used as output devices of composite electronic devices (including, for example, computers or word processors) or as output devices of workstations are constructed so as to record an image on a record medium such as paper or a thin plastic plate based on image information. Such recording devices can be divided into various types depending on the recording method they use, such as inkjet recording devices, wire dot recording devices, thermal recording devices, and laser beam recording devices.

In a serial type recording device which performs a main scanning operation in the direction which intersects the record medium transporting direction (that is, the subscanning direction), a recording means placed on a carriage which moves along the record medium is used to record an image on the record medium. More specifically, an image for one line is recorded by the main scanning operation carried out by the recording means, after which the record medium is advanced (or fed) by a predetermined amount (the "pitch"). After the advance of the record medium, the main scanning operation is carried out again by the recording means to record the next line of image. Thereafter, the advancement of the record medium by the predetermined pitch and the main scanning operation are alternately repeated in order to record all of the images on the entire record medium.

On the other hand, in a line-type recording device which records images only by a subscanning operation by a recording means along a record medium in the subscanning direction, without a main-scanning operation by the recording means, a recording means which extends along the entire record area of the record medium in the widthwise direction thereof is used to record the images on the record medium. More specifically, the record medium is set in position to allow the recording means to record an image for one line all at once. Then, the record medium is advanced (that is, fed) by a predetermined amount (the "pitch"). After the feeding of the record medium, the recording means records the next image for one line all at once. Thereafter, the advancement of the record medium by the predetermined pitch and the recording operations are alternately repeated in order to record all of the images on the entire record medium.

An inkjet recording device records an image on a record medium by ejecting ink from a recording means (that is, an inkjet recording head). The inkjet recording device provides, for example, the following advantages. Its recording head can easily be made compact in size. It can record a high-definition image with high speed. It can carry out a recording operation on plain sheets of paper made without special processing. Its running costs are low. It does not make very much noise because it is a non-impact type recording device. It can easily record a color image by using ink of various colors. In particular, the line-type inkjet recording device using a line-type inkjet recording head having a large number of ink-ejection openings disposed along the widthwise direction of the record medium can perform recording at an even higher speed.

In particular, in an inkjet recording head used in an inkjet recording device which ejects ink using heat energy, a deposited electrothermal converting member, an electrode, a liquid path wall, a top plate, etc., can be formed by semiconductor manufacturing processes, such as etching, evaporation, and sputtering. Therefore, it is possible to easily manufacture inkjet recording heads which have liquid paths (that is, ink-ejection openings) disposed very close together and which are made more compact in size.

There has been a demand for various types of record media. In recent years, there has been a demand for recording devices which allow the use of, in addition to ordinary types of record media such as paper and thin resin plates (such as overhead projector (OHP) plates), thin paper and processed paper (such as filing paper having punched-out holes, paper with perforations, paper having various forms, etc.).

For example, an inkjet recording head used in a serial-scanning-type inkjet recording device is placed on a carriage, and ejects ink from ink-ejection openings while reciprocating in the main scanning direction with the carriage. In this recording head, good ink ejection performance is maintained by wiping the surface of the recording head where the ejection openings are formed (that is, the surface of, for example, a recording element substrate where the ejection openings are formed) by a wiper blade. The wiper blade is, for example, a 0.5 mm thick silicone rubber plate. When the recording head is to be wiped, the recording head and the wiper blade are moved relative to each other while keeping the surface of the recording head where the ejection openings are formed and the wiper blade overlapped by approximately 1 mm. Foreign matter (such as paper powder, dust, or ink deposits) stuck on the surface of the recording head where the ejection openings are formed is wiped off by making the recording head carried by the carriage pass and be wiped by the wiper blade disposed opposite to the recording head, or by making the wiper blade pass and wipe the recording head which is maintained stationary opposite the wiper blade.

In order to cause the wiper blade always to wipe off foreign matter properly, a wiper cleaner (that is, a blade cleaner) is provided in order to clean off foreign matter, such as ink, stuck on the wiper blade by the wiping operation of the wiper blade.

FIGS. 26A, 26B, and 26C illustrate the operations of a wiper blade and a wiper cleaner in a conventional inkjet recording device.

Relative movement of a wiper blade 1 and a wiper cleaner 2 causes the wiper blade 1 to pass by a scraping-off edge section 2A of the wiper cleaner 2 while the wiper blade 1 bends, causing any foreign matter, such as ink, stuck near the end of the wiper blade 1 to be scraped off by the wiper cleaner 2.

The wiper cleaner 2 is formed of a material which absorbs ink so that it can scrape off any ink stuck on the wiper blade 1.

However, the inkjet recording device including the aforementioned wiper blade 1 and the wiper cleaner 2 still has the following problems.

(1) When the planar surface of the wiper blade 1 and the planar surface of the wiper cleaner 2 come into contact with each other, foreign matter 3, such as ink, is scattered around the wiper blade 1 and the wiper cleaner 2.

(2) The foreign matter 3, such as ink, accumulates on the wiper cleaner 2, so that the wiper blade 1 is cleaned less effectively, and is, thus, stained with ink. When a large amount of foreign matter 3, such as ink, sticks on the wiper blade 1 and the wiper cleaner 2, the foreign matter 3 moves past the scraping edge section 2A without being removed from the wiper blade.

SUMMARY OF THE INVENTION

Accordingly, it is an object of the present invention to provide an inkjet recording head cleaning device which can reduce scattering of ink when a wiper blade is being cleaned, and which allows the wiper blade to be unerringly cleaned by a wiper cleaner over a long period of time. It is also an object of the present invention to provide an inkjet recording device that includes such cleaning device.

To this end, according to one aspect of the present invention, there is provided a cleaning device for an inkjet recording head for wiping a portion of the inkjet recording head which discharges ink by a resilient wiper blade, and for cleaning the wiper blade by a wiper cleaner. The cleaning device comprises a unit to effect relative motion of the wiper blade and the wiper cleaner relative to each other so that the wiper blade and the wiper cleaner come into contact with each other, and a contact range limiter, disposed on at least one of the wiper blade and the wiper cleaner opposing each other, for limiting the range of contact of the wiper blade and the wiper cleaner when the wiper blade and the wiper cleaner start coming into contact with each other.

According to another aspect of the present invention, there is provided a cleaning device for an inkjet recording head for wiping a portion of the inkjet recording head which discharges ink by a resilient wiper blade, and for cleaning the wiper blade by a wiper cleaner. The cleaning device comprises an accumulation area limiter, disposed on the wiper cleaner, for limiting the accumulation area of foreign matter scraped off from the wiper blade.

According to still another aspect of the present invention, there is provided a inkjet recording device for recording an image on a record medium using an inkjet recording head which discharges ink. The inkjet recording device comprises the above-described cleaning devices for cleaning a portion of the inkjet recording head.

Further objects, features and advantages of the present invention will become apparent from the following description of the preferred embodiments with reference to the attached drawings.

DESCRIPTION OF THE PREFERRED EMBODIMENTS

A description of the preferred embodiments of the present invention will now be given with reference to the drawings.

In the specification, the term "print" or "record" is broadly defined. It not only refers to forming significant information such as characters or figures, but also refers to forming, for example, images, designs, or patterns, regardless of whether they are significant or insignificant and regardless of whether they can be seen by the user; and to processing a medium.

The term "print medium" is broadly defined as not only referring to paper used in commonly used printers, but also to other types of media which can receive ink, such as cloth, plastic films, metallic plates, glass, ceramics, wood, and leather.

Like the term "print," the term "ink" (or "liquid") is broadly defined. It refers to a liquid used to process a print medium or used to form, for example, an image, a design, or a pattern on a print medium by applying it thereto. It also refers to a liquid used to process ink (so that, for example, coloring material in the ink applied to a print medium is solidified or is made insoluble).

In the preferred embodiments described below, an inkjet printer is used as an example of a recording device, but the invention is not limited to that example.

Basic Structure

The basic structure of the printer is described with reference to FIGS. 1 to 18.

Body of the Printer

Figure 1:
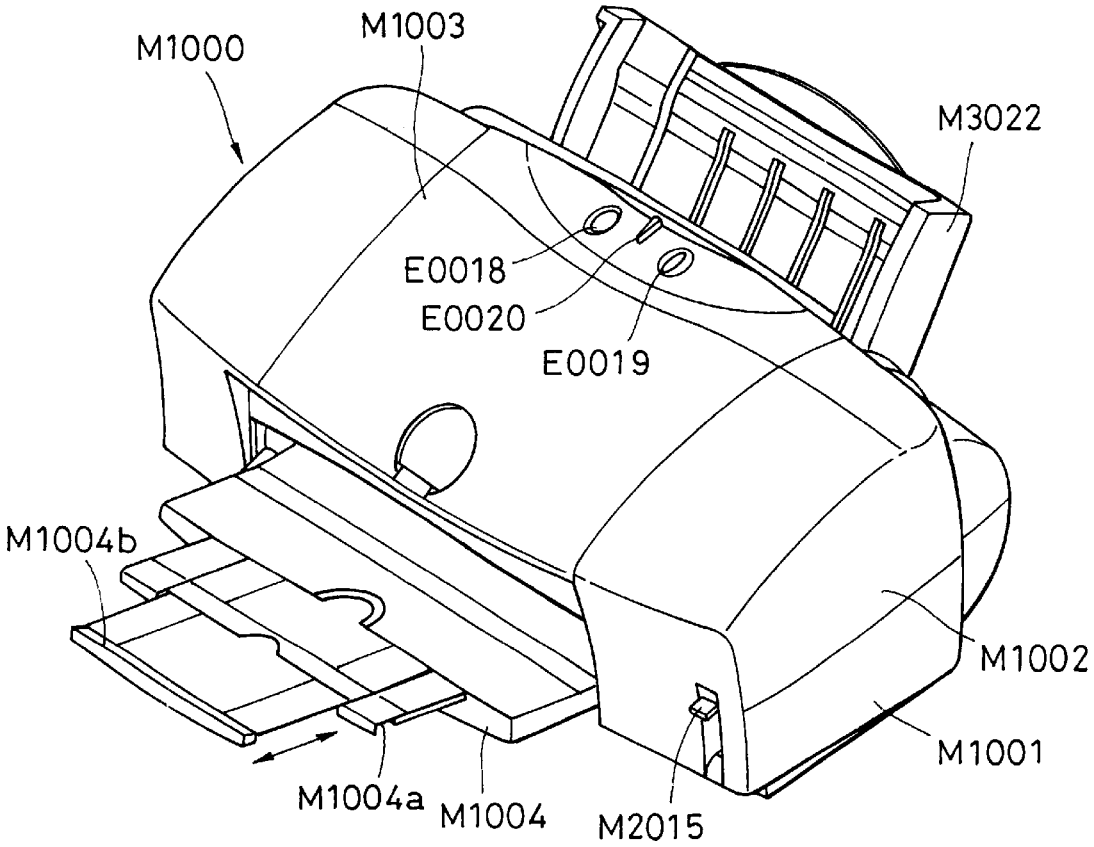
FIG. 1 is a perspective view of the external structure of an embodiment of an inkjet printer in accordance with the present invention.
Figure 2:
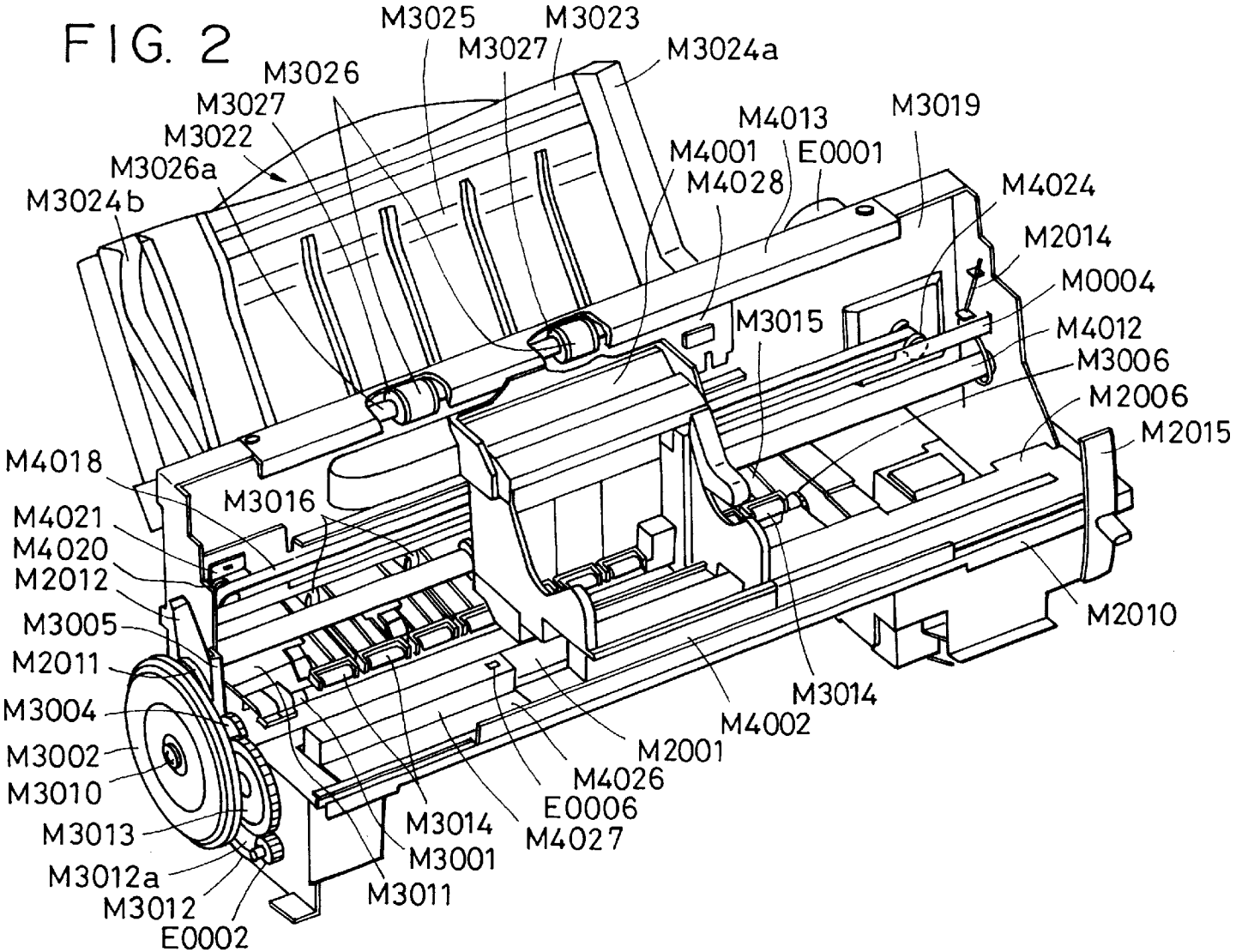
FIG. 2 is a perspective view showing the embodiment of the inkjet printer shown in FIG. 1 without the external component parts of the inkjet printer shown in FIG. 1.

FIGS. 1 and 2 schematically illustrate an inkjet printer. In FIG. 1, a printer body M1000 which forms the outer portion of the printer of the present embodiment comprises external members and a chassis M3019 (shown in FIG. 2) accommodated within the outer members. The external members are a bottom case M1001, a top case M1002, an access cover M1003, and a discharge tray M1004.

The chassis M3019 is formed of a plurality of plate-shaped metallic members having a predetermined rigidity, forms the framework of the printer, and is used to hold a recording operation mechanism (described later).

The bottom case M1001 substantially forms the bottom half portion of the printer body M1000. The top case M1002 substantially forms the top half portion of the printer body M1000. When both of the cases are combined, a hollow structure having a space for accommodating the mechanism (described later) in the printer body M1000 is formed. Openings are formed in the top and front surfaces of the printer body M1000.

One end of the discharge tray M1004 is rotatably held by the bottom case M1001. By rotating the one end of the discharge tray M1004, the opening in the front surface of the bottom case M1001 is covered and uncovered. Accordingly, in the case where a recording operation is carried out, when the opening in the front surface of the bottom case M1001 is uncovered as a result of rotating the discharge tray M1004 towards the front side, record sheets P can be discharged from the opening and successively placed on the discharge tray M1004. Two auxiliary trays M1004*a* and M1004*b* are accommodated in the discharge tray M1004. When necessary, these trays can be drawn out forwardly (in the direction of the arrow), so that the sheet supporting area can be enlarged and reduced in size in three stages.

One end of the access cover M1003 is rotatably held by the top case M1002 in order to cover and uncover the opening formed in the top surface of the printer body M1000. By opening the access cover M1003, a recording head cartridge H1000 or an ink tank H1900 accommodated in the interior of the printer body M1000 can be replaced. Although not illustrated, when the access cover M1003 is opened or closed, a protrusion formed on the back surface thereof causes a cover opening-and-closing lever to rotate. By detecting the rotational position of the lever by, for example, a microswitch, the opening-and-closing state of the access cover M1003 can be detected.

A power supply key E0018 and a resume key E0019 are provided on the top surface of the back portion of the top case M1002 so that they can be pressed. A light-emitting diode (LED) E0020 is also provided on the top surface of the back portion of the top case M1002. When the power supply key E0018 is pressed, the LED E0020 turns on to inform the operator that a recording operation can be carried out. Various indication functions which inform the operator of, for example, a printer problem are provided. They include changing the operation (e.g., blinking versus steady) or the color of the LED E0020 and sounding a buzzer E0021 (shown in FIG. 15). When the problem is overcome, the recording operation is started again by pressing the resume key E0019.

Recording Operation Mechanism

A description of a recording operation mechanism accommodated in and held by the printer body M1000 used in the embodiment will now described.

The recording operation mechanism used in the embodiment comprises an automatic sheet feed section M3022, a transportation section M3029, a recording section M4000, and a recovery section M5000. The automatic sheet feed section M3022 is used to automatically transport record sheets P into the printer body M1000. The transportation section M3029 is used to guide the record sheets P sent out one sheet at a time from the automatic sheet feed section M3022 to desired recording locations, and to guide the record sheets P from their desired recording locations to the discharge section M3030. The recording section M4000 is used to carry out a desired recording operation on the record sheets P transported to the transportation section M3029. The recovery section M5000 is used to carry out a recovery operation on, for example, the recording section M4000.

A description of the structure of each section will now be given.

Automatic Sheet Feed Section

The automatic sheet feed section M3022 will be described with reference to FIGS. 2 and 3.

The automatic sheet feed section M3022 used in the embodiment sends out record sheets P loaded at an angle of from approximately 30° to 60° from the horizontal plane, and discharges the record sheets P into the printer body M1000 from a sheet-feed opening (not shown) while maintaining the record sheets P in a substantially horizontal state.

More specifically, the automatic sheet feed section M3022 comprises sheet-feed rollers M3026, a movable side guide M3024, a pressure plate M3025, an ASF base M3023, separating sheets M3027, and a separating pawl (not shown). Of these component parts of the automatic sheet feed section M3022, the ASF base M3023 substantially forms the outer portion of the automatic sheet feed section 3022, and is disposed at the back side of the printer body M1000. The pressure plate M3025 for supporting the record sheets P is mounted to the front surface of the ASF base M3023 at an angle of approximately 30° to 60° from the horizontal plane. A pair of sheet guides M3024*a* and M3024*b* for guiding both edges of the record sheets P are provided so as to protrude from the front surface of the ASF base M3023. The sheet guide M3024*b* can be moved horizontally to match the sizes (or widths) of the record sheets P in the horizontal direction.

Driving shafts 3026*a* which moves in response to a PG motor E0003 through a transmission gear (not shown) are rotatably supported by both left and right side surfaces of the ASF base M3023. The driving shafts M3026*a* have a plurality of sheet-feed rollers having oddly shaped peripheral surfaces secured thereto.

When the sheet-feed rollers M3026 rotate in response to the driving of the PG motor E0003 (shown in FIG. 15), the separating sheets M3027 and the separating pawl separate the record sheets P loaded on the pressure plate M3025 successively one sheet at a time from the topmost of the record sheets P in order to send and transport them to the transportation section M3029. Since the bottom end of the pressure plate M3025 is resiliently supported by a pressure-plate spring M3028 disposed between the pressure plate M3025 and the ASF base M3023, the press-contact force between the sheet-feed rollers M3026 and the recording sheets P can be kept constant regardless of the number of recording sheets P loaded.

In the path from the automatic sheet-feed section M3022 to the transportation section M3029 in which the record sheets P are transported, a PE lever M3020 is rotatably attached to the chassis M3019. The PE lever M3020 is urged clockwise in FIG. 3 by the PE lever spring M3021. The chassis M3019 is affixed to the printer body M1000 and is formed of a plate-shaped, metallic member having a predetermined rigidity. The separated record sheets P transported from the automatic sheet-feed section M3022 pass through the aforementioned path, and edges of the record sheets P push and rotate an end of the PE lever M3020. A PE sensor (not shown) detects the rotation of the PE lever M3020 in order to detect the entry of the record sheets P into the transportation path.

After the detection of the entry of the record sheets P into the transportation path, the record sheets P are transported downstream by a previously determined distance by the sheet-feed rollers M3026. After edges of the record sheets P have come into contact with a nip section of an LF roller M3001 and pinch rollers M3014, which are disposed at the transportation section M3029 (described later) and which are not moving, the sheet-feed rollers M3026 stop transporting the recording sheets P having approximately 3 mm loops.

Transportation Section

Figure 4:
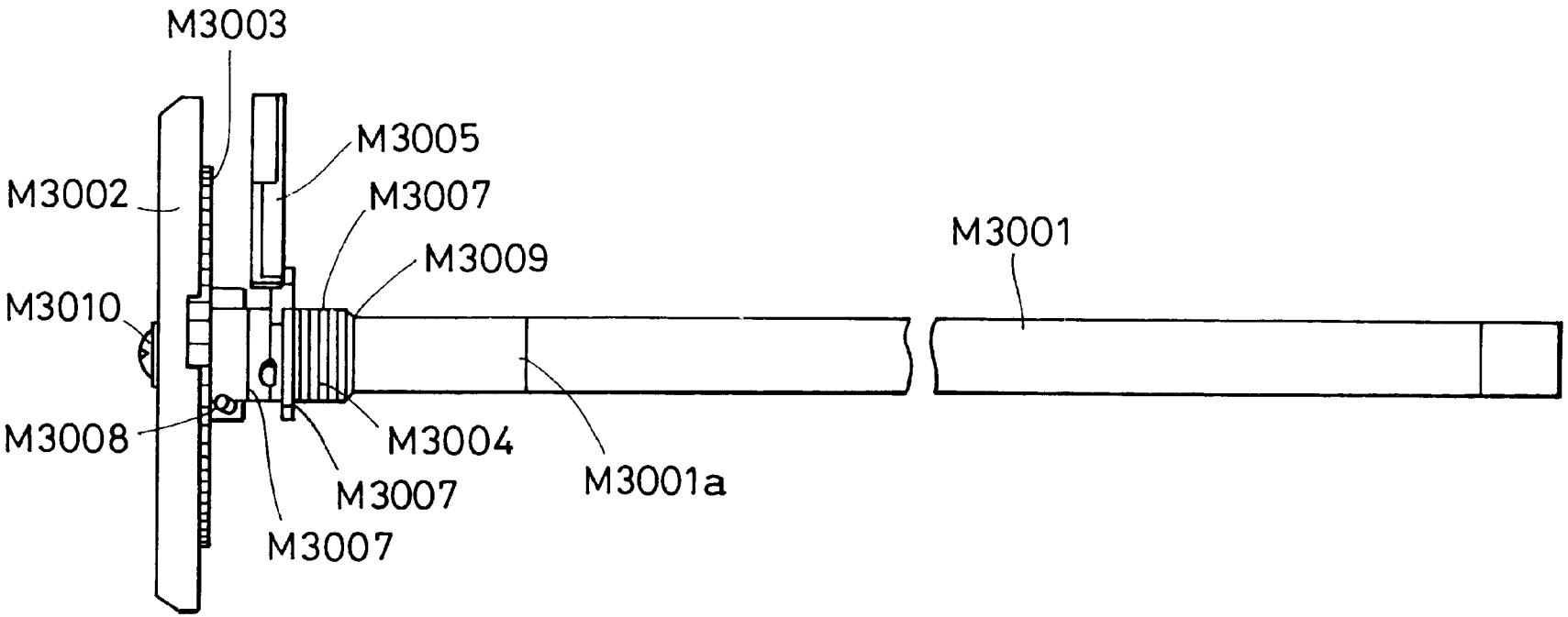
FIG. 4 is a front view of a sheet feed roller, an LF gear cover, etc., shown in FIG. 2.
Figure 5:
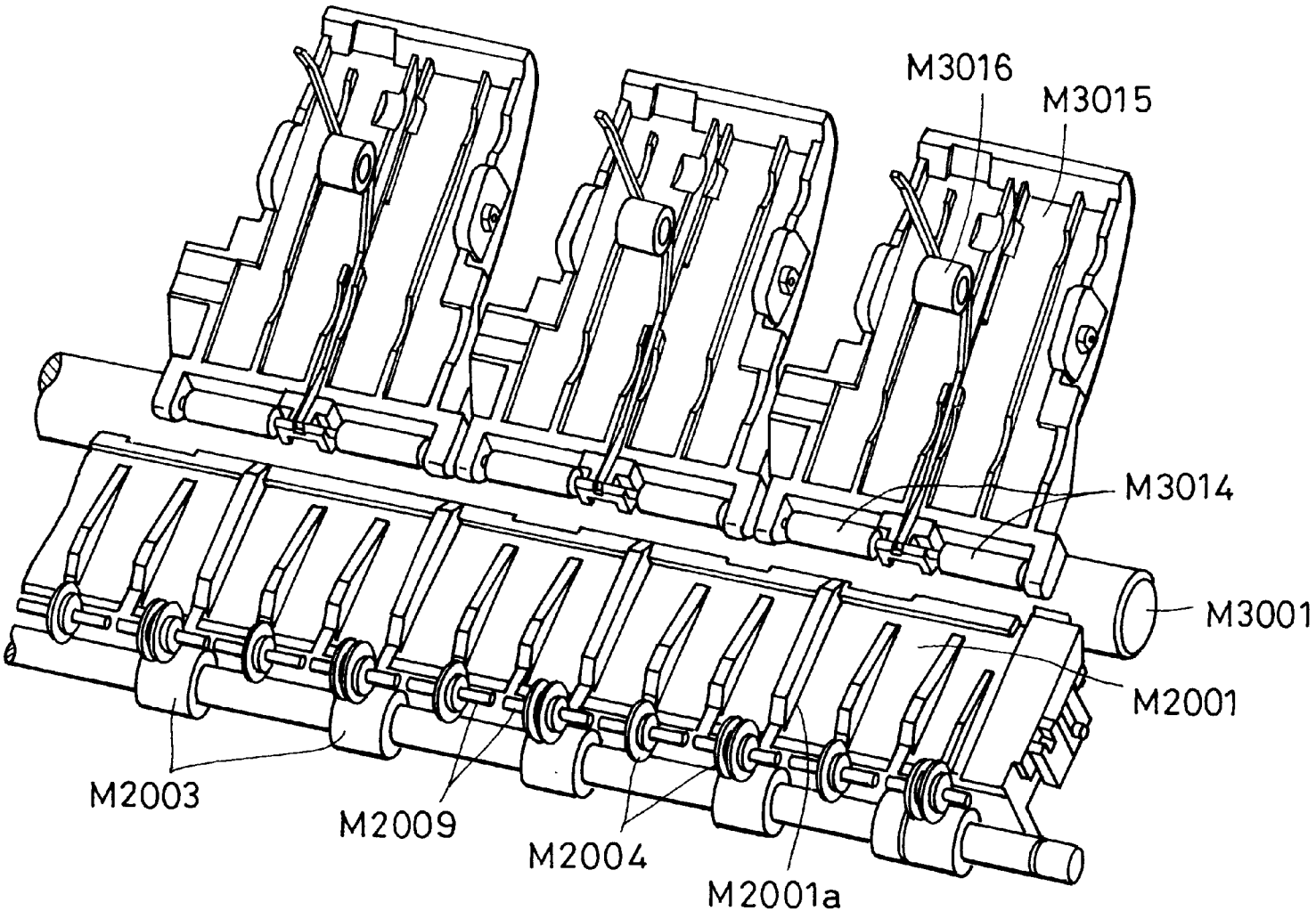
FIG. 5 is a perspective view of a pinch roller, etc., shown in FIG. 2.

The transportation section M3029 comprises the LF roller M3001, the pinch rollers M3014, and a platen M2001. The LF roller M3001 is secured to a driving shaft rotatably supported by, for example, the chassis M3019. As shown in FIG. 4, an LF gear cover M3002 is mounted to one end of the LF roller M3001. Accordingly, an LF gear M3003, secured to a driving shaft M3001*a*, and a small gear M3012*a* (shown in FIG. 2) of an LF intermediate gear M3012, which engages the LF gear M3003, can be protected at the same time. The LF intermediate gear M3012 moves in response to a driving gear provided at a driving shaft of an LF motor E0002 (described later), and rotates by the driving force of the LF motor E0002.

The pinch rollers M3014 are rotatably attached to an end of a pinch roller holder M3015 rotatably supported by the chassis M3019, and are press-contacted against the LF roller M3001 by a wound pinch roller spring M3016 for urging the pinch roller holder M3015. The pinch rollers M3014 rotate in accordance with the rotation of the LF roller M3001 in order to transport the record sheets P which have loops and which are not moving as described above towards the front while the record sheets P are nipped between the pinch rollers M3014 and the LF roller M3001.

The centers of rotation of the pinch rollers M3014 are offset downstream from the center of rotation of the LF roller M3001 by approximately 2 mm in the sheet transportation direction. Therefore, the record sheets P are transported obliquely towards the right and downward in FIG. 3 by the LF roller M3001 and the pinch rollers M3014. Consequently, the record sheets P are transported along a record sheet supporting surface M2001*a* (shown in FIG. 5) of the platen M2001.

In the transportation section M3029 having the above-described structure, when a certain amount of time elapses from the time the sheet-feed rollers M3026 of the automatic sheet-feed section M3022 have stopped transporting the record sheets P, the driving of the LF motor E0002 is started. The driving power of the LF motor E0002 is transmitted to the LF roller M3001 through the LF intermediate gear M3012 and the LF gear M3003, causing the record sheet P whose edge is in contact with the nip section between the LF roller M3001 and the pinch rollers M3014 to be transported to the recording operation start position on the platen M2001 by the rotation of the LF roller M3001.

Here, the rotation of the sheet-feed rollers M3026 is started at the same time as the rotation of the LF roller M3001, so that the record sheets P are transported downstream as a result of the sheet-feed rollers M3026 and the LF roller M3001 cooperating with each other for a predetermined amount of time.

The recording head cartridge H1000 moves with a carriage M4001 which reciprocates along a carriage shaft M4012, having both ends secured to the chassis M3019, in the scanning direction perpendicular to the direction in which the record sheets P are transported. The recording head cartridge H1000 is used to discharge ink onto a record sheet P waiting at the recording operation start location, whereby an image is recorded using ink based on a piece of predetermined image information.

After the recording of the image with ink, the record sheet P having the image formed thereon is transported by a predetermined amount by lines, such as 5.42 mm, as a result of the rotation of the LF roller M3001. After the transportation of the record sheet P has been completed, the carriage M4001 is used to execute a main scanning operation along the carriage shaft M4012. The transportation of a record sheet P and the main scanning operation are repeated in order to record an image on the record sheet P on the platen M2001.

One end of the carriage shaft M4012 is mounted to a sheet adjusting plate (not shown) through a sheet adjusting lever M2015, whereas the other end of the carriage shaft M4012 is mounted to a sheet adjusting plate M2012 through a carriage shaft cam M2011. Through a carriage shaft spring M2014, both ends of the carriage shaft M4012 are mounted in an urged state to the sheet adjusting plate that is not shown and to the sheet adjusting plate M2012, respectively. The sheet adjusting plate M2012 and the sheet adjusting plate (not shown) are adjusted so that the ink ejection surface of the recording head cartridge H1000 and the record sheet supporting surface M2001*a* of the platen M2001 are separated by a suitable distance, and are affixed to the chassis M3019.

By the action of a sheet lever spring (not shown), the sheet adjusting lever M2015 can be selectively set at two stopping positions, that is, at the top end position and at the bottom end position. The sheet adjusting lever M2015 shown in FIG. 1 is at the top end position. When the sheet adjusting lever M2015 is moved to the bottom end position, the carriage M4001 withdraws to a distance of approximately 0.6 mm from the platen M2001. Therefore, when record sheets P as thick as envelopes are used, the sheet adjusting lever M2015 is previously moved to the bottom end position in order to start feeding the record sheets P from the automatic sheet feed section M3022.

When the sheet adjusting lever M2015 is moved to the bottom end position, a GAP sensor 0008 (shown in FIG. 15) detects that the sheet adjusting lever M2015 is at the bottom end position. Therefore, when the feeding of the record sheets P is started by the automatic sheet feed section M3022, the GAP sensor 0008 determines whether or not the sheet adjusting lever M2015 is set at the proper position. If it determines that the sheet adjusting lever M2015 is not at the proper position, it gives out a warning by displaying a message or sounding a buzzer, so that any improper recording operation can be prevented beforehand.

Discharge Section

A description of the discharge section M3030 will now be given with reference to FIG. 3.

Figure 3:
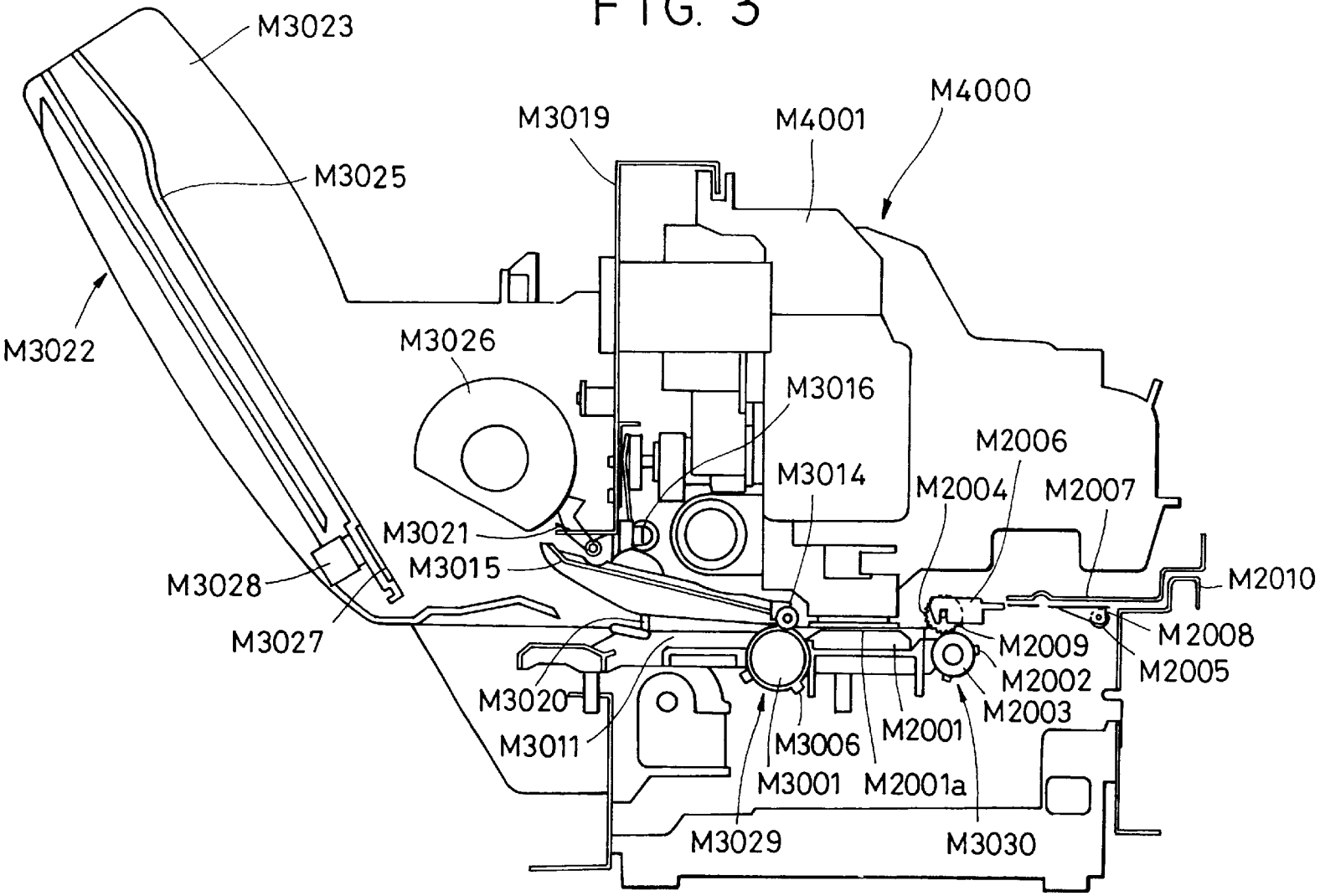
FIG. 3 is a side view of the inkjet printer shown in FIG. 2.

As shown in FIG. 3, the discharge section M3030 comprises a discharge roller M2003, a discharge gear M3013, a first spur M2004, and a discharge tray M1004. The discharge gear M3013 is mounted to the discharge roller M2003, and transmits the driving power of the LF motor E0002 to the discharge roller M2003 through the LF intermediate gear M3012. The first spur M2004 is pressed against the discharge roller M2003 by the urging force of a spur spring shaft M2009 mounted to a first spur holder M2007 mounted to a spur stay M2006, and rotates in accordance with the rotation of the discharge roller M2003 in order to transport a record sheet P while it is nipped between it and the discharge roller M2003. The discharge tray M1004 is used to assist the discharge of the record sheet P.

The record sheet P transported to the sheet discharge section M3030 is subjected to the transporting force produced by the discharge roller M2003 and the first spur M2004. Since the center of rotation of the first spur M2004 is offset upstream from the center of rotation of the discharge roller M2003 by approximately 2 mm in the sheet transportation direction, the record sheet P transported by the discharge roller M2003 and the first spur M2004 are lightly in contact with the record sheet supporting surface 2001*a* of the platen M2001 without any gap formed therebetween. Therefore, the record sheet P is properly and smoothly transported.

The sheet transportation speeds of the discharge roller M2003 and the first spur M2004 are about the same as the sheet transportation speeds of the LF roller M3001 and the pinch rollers M3014. In order to further prevent bending of the record sheet P, the sheet transportation speeds of the discharge roller M2003 and the first spur M2004 are set slightly higher than the sheet transportation speeds of the LF roller M3001 and the pinch rollers M3014.

In order to prevent the record sheet P from rubbing against the spur stay M2006, a second spur M2005 mounted to a second spur holder M2008 is held by the spur stay M2006, at a portion of the first spur M2004 at the downstream side.

When the recording of the image with ink on the record sheet P is completed, and the back edge of the record sheet P moves out from between the LF roller M3001 and the pinch rollers M3014, the record sheet P is transported only by the discharge roller M2003 and the first spur M2004 in order to complete the discharging of the record sheet P.

Recording Section

A description of the recording section M4000 will now be given.

The recording section M4000 comprises the carriage M4001, movably supported by the carriage shaft M4021, and the head cartridge H1000, removably placed on the carriage M4001.

Recording Head Cartridge

A description of the head cartridge will now be given with reference to FIGS. 6 to 8.

Figure 6:
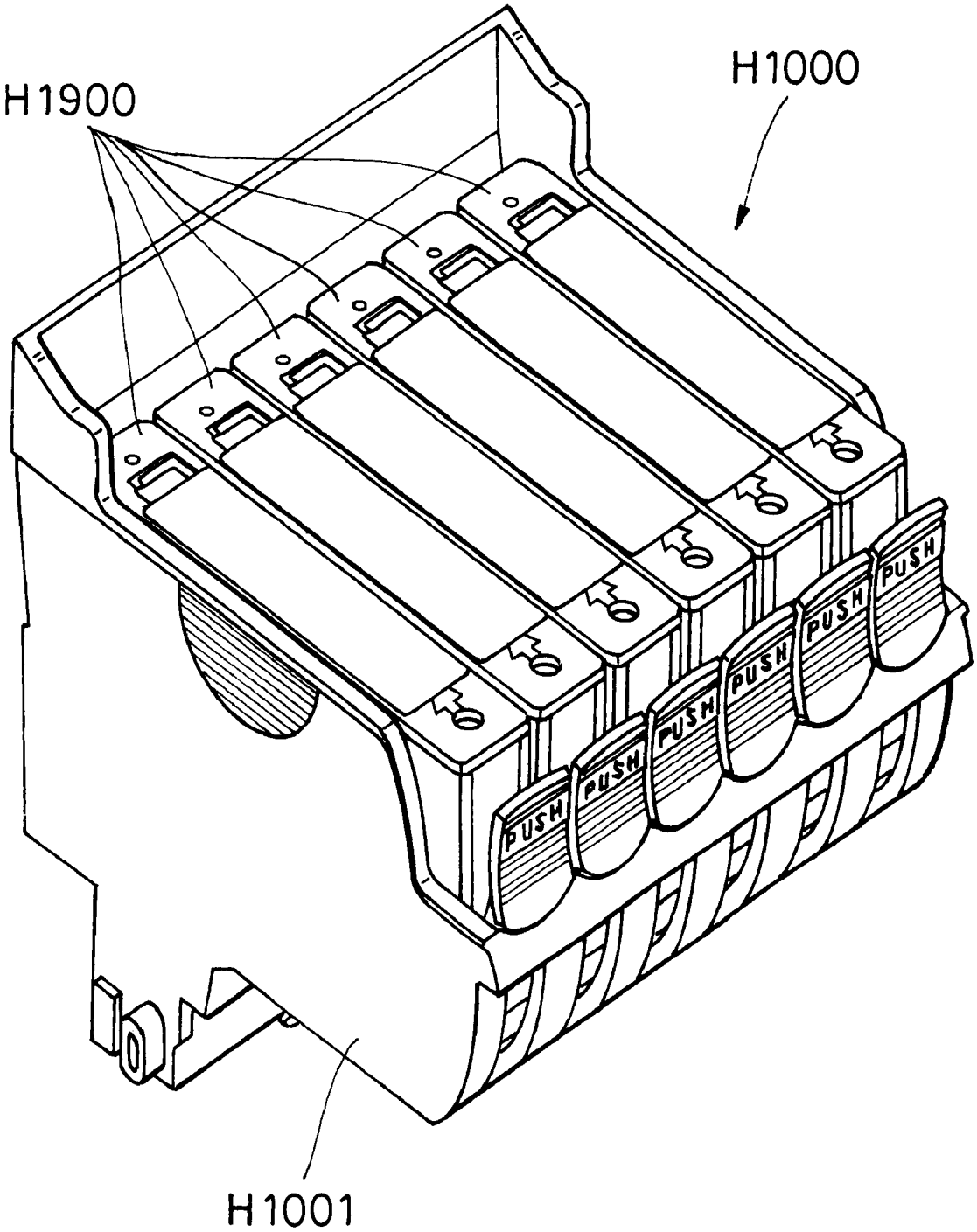
FIG. 6 is a perspective view of a recording head cartridge used in the embodiment of the present invention.
Figure 7:
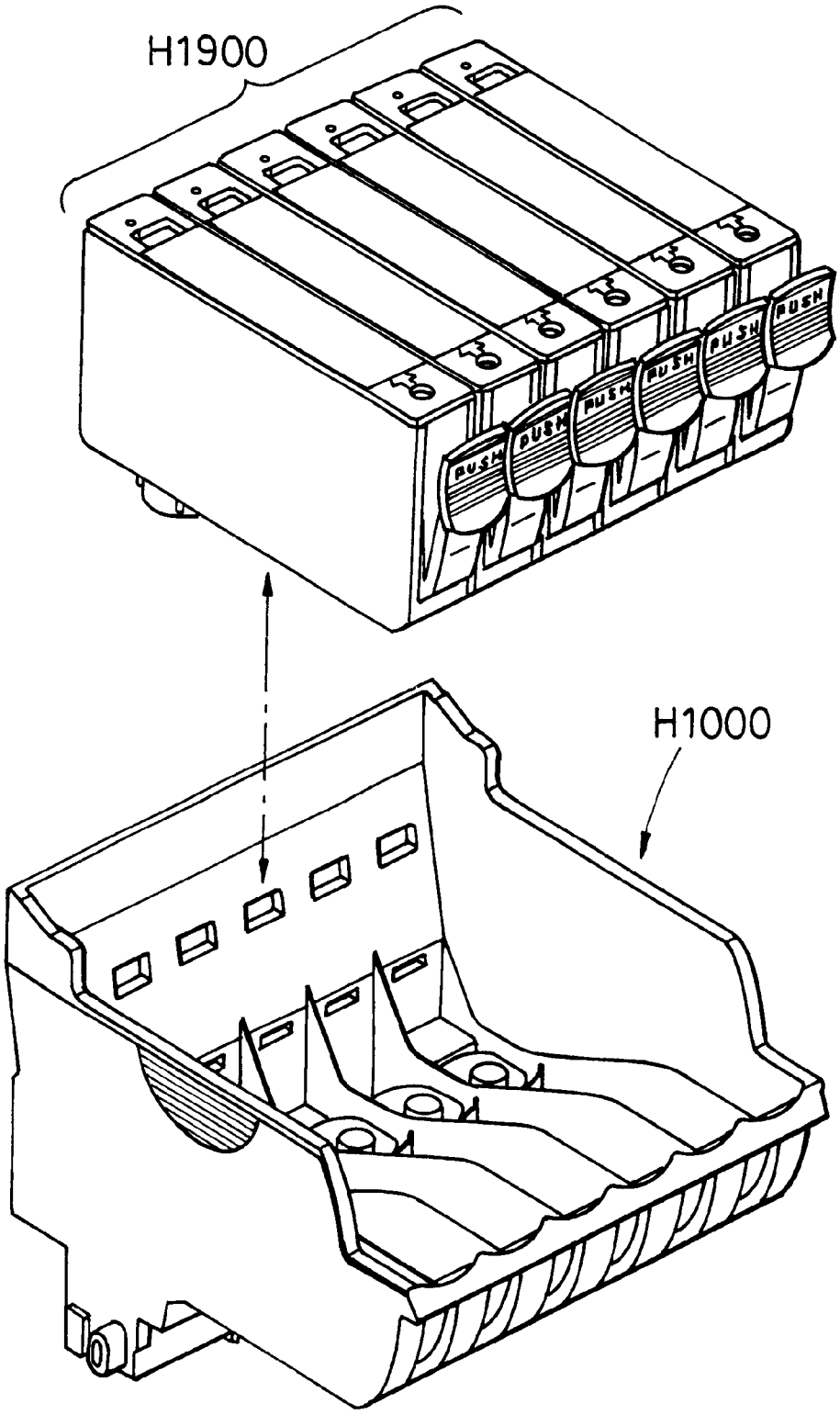
FIG. 7 is a perspective view of a state in which the recording head cartridge shown in FIG. 6 is assembled.

As shown in FIG. 6, the recording head cartridge H1000 used in the embodiment comprises ink tanks H1900 and a recording head H1001. The ink tanks H1900 hold ink. The recording head H1001 discharges ink supplied from the ink tanks H1900 in accordance with recording information from a nozzle thereof. The recording head H1001 is removably placed on the carriage M4001 (described later). Accordingly, the recording head H1001 is a cartridge-type recording head.

In order to make it possible to achieve a high-quality, color recording operation providing a photographic tone, ink with different colors, such as black ink, light cyan ink, light magenta ink, cyan ink, magenta ink, and yellow ink, are provided for the ink tanks H1900 in the recording head cartridge H1000. As shown in FIG. 7, the ink tanks H1900 are removable from the recording head H1001.

Figure 8:
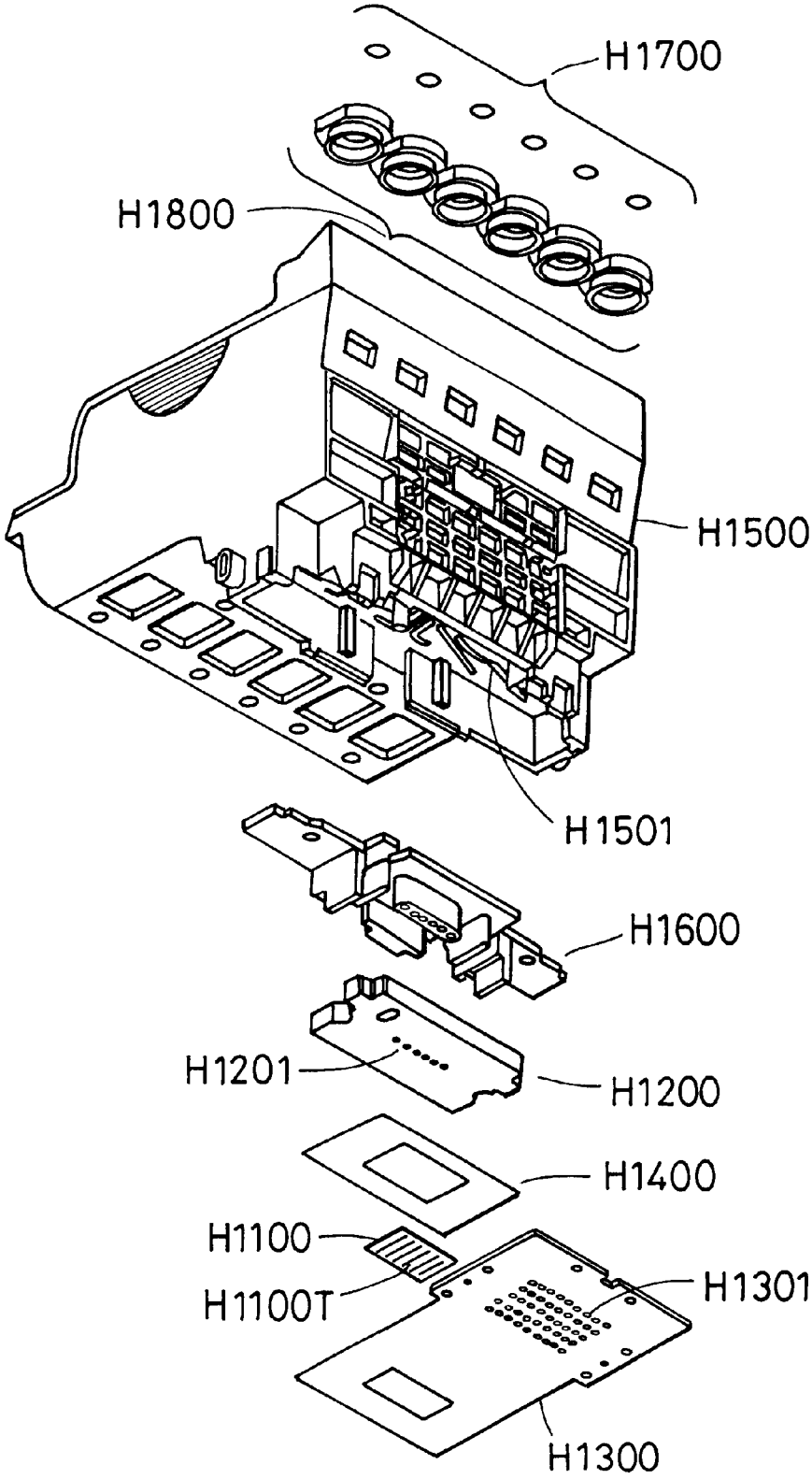
FIG. 8 is an exploded perspective view of the recording head cartridge shown in FIG. 7 as seen from obliquely therebelow.

As shown in FIG. 8, which is an exploded perspective view, the recording head H1001 comprises a recording element substrate H1100, a first plate H1200, an electrical wiring board H1300, a second plate H1400, a tank holder H1500, a passage forming member H1600, filters H1700, and a seal rubber H1800.

A plurality of recording elements and an electrical wiring are formed on the recording element substrate H1100 by a film-deposition technology. The plurality of recording elements are provided to discharge ink onto one surface of a silicon (Si) substrate. The electrical wiring is formed of, for example, aluminum (Al), and is provided to supply electrical power to the plurality of recording elements. A plurality of discharge openings H1100T and a plurality of ink passages formed in correspondence with the recording elements are formed in the recording element H1100 by the photolithography technique. Ink supply openings for supplying ink are formed in the back sides of the plurality of ink passages. The recording element substrate H1100 is adhered to the first plate H1200. The first plate H1200 includes ink supply openings H1201 for supplying ink to the recording element substrate H1100. The second plate H1400 having an opening is adhered to the first plate H1200. The second plate H1400 holds the electrical wiring board H1300 so that the electrical wiring board H1300 and the recording element substrate H1100 are electrically connected together. The electrical wiring board H1300 is used to apply an electrical signal for discharging ink to the recording element substrate H1100. The electrical wiring board H1300 comprises electrical wiring formed in correspondence with the recording element substrate H1100, and an external signal input terminal H1301 disposed at an end of the electrical wiring in order to receive an electrical signal from the printer body M1000. The external signal input terminal 1301 is positioned at and secured to the back surface of the tank holder H1500 (described later).

The passage forming member H1600 is ultrasonically welded to the tank holder H1500 for removably holding the ink tanks H1900, and forms an ink passage H1501 from the ink tanks H1900 to the first plate H1200. The filters H1700 are provided on the end of the ink tank side of the ink passage H1501 engaging the ink tanks H1900 in order to prevent entry of dust from the outside. The seal rubber H1800 is mounted to the portion of the ink passage H1501 that engages the ink tanks H1900 in order to prevent evaporation of ink from the engaging portion of the ink passage H1501.

A tank holder section comprising the tank holder H1500, the passage forming member H1600, the filters H1700, and the seal rubber H1800, and a recording element section comprising the recording element substrate H1100, the first plate H1200, the electrical wiring board H1300, and the second plate H1400, are joined together with, for example, an adhesive, whereby the recording head H1001 is constructed.

Carriage

Figure 9:
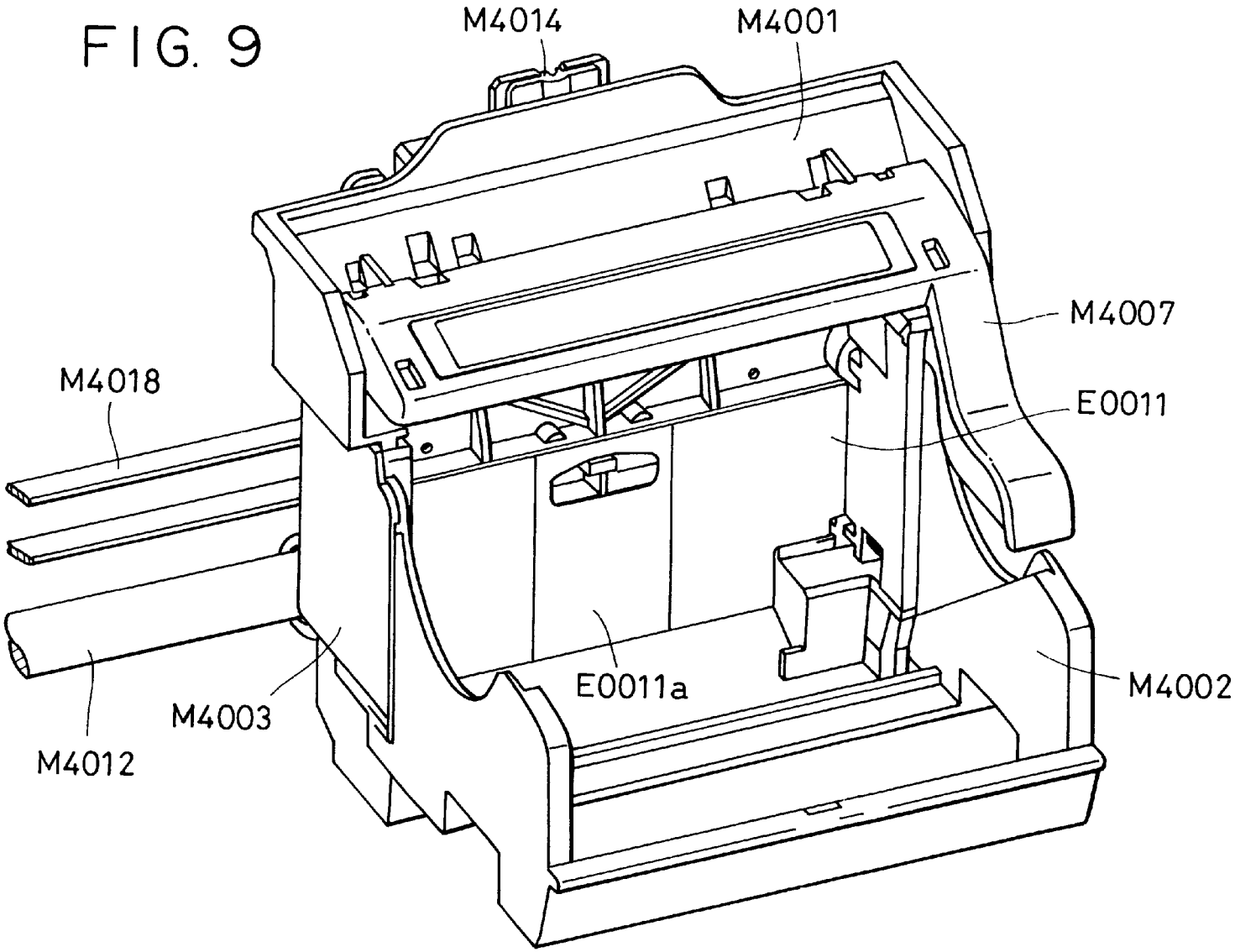
FIG. 9 is a front perspective view of a carriage used in the embodiment of the present invention.

A description of the carriage M4001 will now be described with reference to FIGS. 2, 9 and 10.

As shown in these figures, a carriage cover M4002 and a head set lever M4007 are provided at the carriage M4001. The carriage cover M4002 engages the carriage M4001 and guides the recording head H1001 to the location where the carriage M4001 is to be mounted. The head set lever M4007 engages the tank holder H1500 of the recording head H1001 and pushes the recording head H1001 so that it is mounted at the predetermined mounting location.

The head set lever M4007 is provided on the top portion of the carriage M4001 so as to be rotatable around a head set lever shaft M4008. Through a spring, a head set plate (not shown) is provided at a portion of the head set lever M4007 that engages the recording head H1001. The recording head H1001 is mounted to the carriage M4001 while pressing it by the force of the spring.

A contact flexible print cable (hereinafter referred to as "contact FPC") E0011 is provided at another portion of the carriage M4001 that engages the recording head H1001. A contact section E0011*a* on the contact FPC E0011 and the external signal input terminal (or contact section) H1301 of the recording head H1001 electrically contact each other in order to, for example, transmit and receive various types of information for recording or to supply electrical power to the recording head H1001.

A resilient member, such as a rubber member, is provided between the carriage M4001 and the contact section E0011*a* of the FPC E0011. The contact section E0011*a* and the carriage M4001 can reliably contact each other by the resilient force of the resilient member and the pressing force of a head set lever spring. The contact FPC E0011 is drawn out from both side surfaces of the carriage M4001. As shown in FIGS. 9 and 10, by a pair of FPC holders M4003 and M4006, both end portions of the contact FPC E0011 are sandwiched by and secured to both sides of the carriage M4001, and connected to a carriage board E0013 provided on the back surface of the carriage M4001 (shown in FIG. 10).

Figure 10:
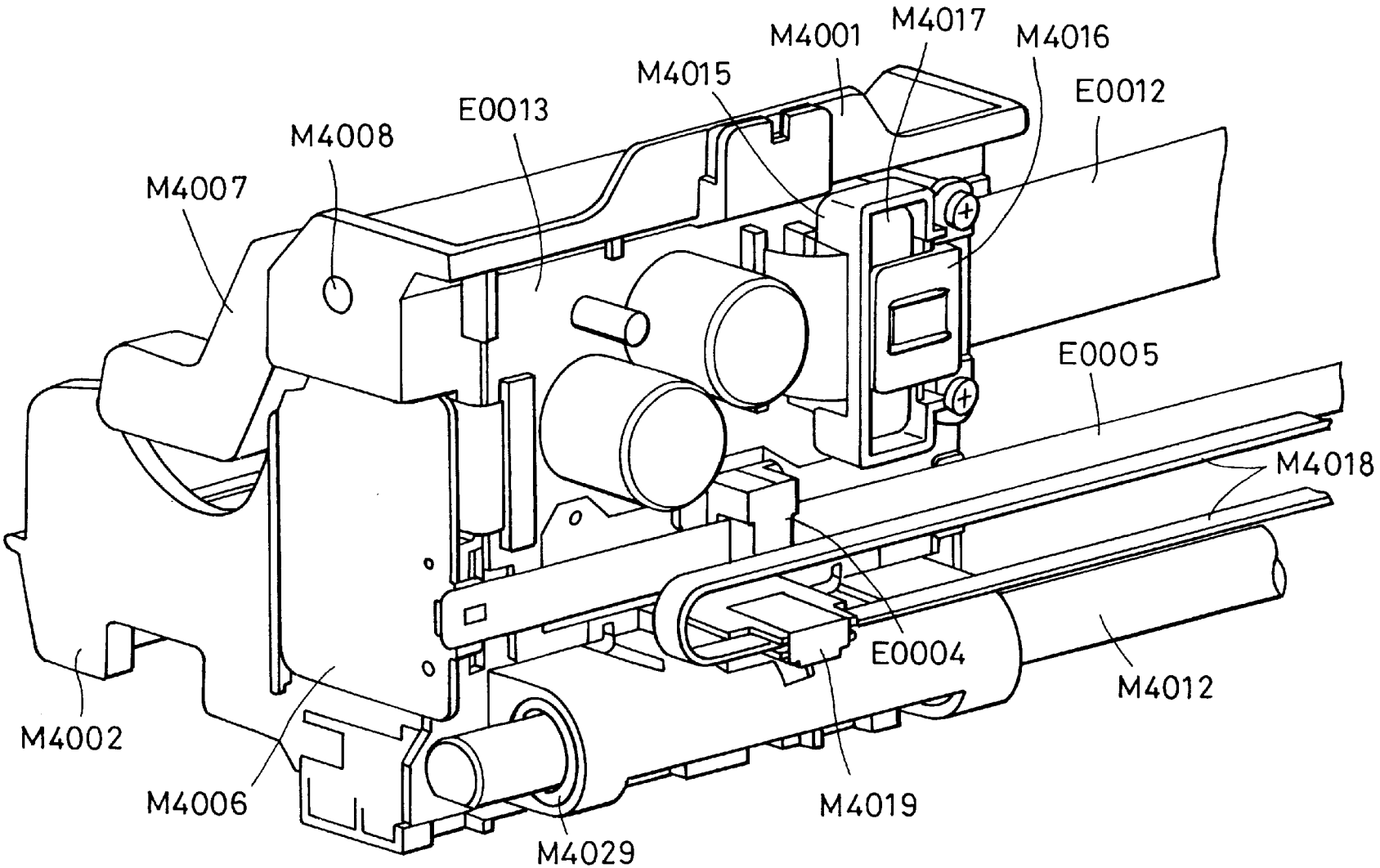
FIG. 10 is a perspective view of the back side of the carriage shown in FIG. 9.

As shown in FIG. 10, by a carriage flexible flat cable (hereinafter referred to as "carriage FFC") E0012, the carriage board E0013 is electrically connected to a main board E0014 (shown in FIG. 15 and described later) provided on the chassis M3019. As shown in FIG. 10, a set of a flexible flat cable holder 2 (FFC holder 2) M4015 and an FFC holder 2*a* M4016 are provided at a portion where one end of the carriage FFC E0012 and the carriage board E0013 are joined together. The carriage FFC E0012 is secured to the carriage board E0013 (shown in FIG. 15). A ferrite core M4017 is provided to block electromagnetic waves radiated from, for example, the carriage FFC E0012.

The other end of the carriage FFC E0012 is secured to the chassis M3019 (shown in FIG. 2) by an FFC holder M4028 (shown in FIG. 2). It is led out from the back surface of the chassis M3019 through a hole (not shown) formed in the chassis M3019, and is connected to the main board E0014 (shown in FIG. 15).

As shown in FIG. 10, an encoder sensor E0004 is provided on the carriage board E0013. The encoder sensor E0004 can detect, for example, the scanning speed and the position of the carriage M4001 as a result of detecting information on an encoder scale E0005 laid parallel to the carriage shaft M4012 in a tensioned state between both sides of the chassis M3019. In the embodiment, the encoder sensor E0004 is an optical, transmissive-type sensor. The encoder scale E0005 is formed by alternately printing a light-shielding section and a light-transmitting section at predetermined pitches on a resinous film (such as a polyester resin film) by, for example, a photomechanical process. The light-shielding section blocks detection light from the encoder sensor E0004. The light-transmitting section transmits the detection light therethrough.

The position of the carriage M4001 moving along the carriage shaft M4012 is detected at all times by making the carriage M4001 bump into one of the side plates of the chassis M3019, and, using the position where the carriage M4001 bumps into the side plate as a reference, by counting the number of patterns formed on the encoder scale E0005 based on the encoder sensor E0004 as the scanning of the carriage M4001 is carried out. The side plate is provided on one end of the scanning path of the carriage M4001.

The carriage M4001 is constructed so that scanning is carried out as a result of guiding it by the carriage shaft M4012 and a carriage rail M4013 installed between both sides of the chassis M3019. A pair of carriage bearings M4029 are integrally formed with receiving sections of the carriage shaft M4012 by, for example, insert molding. The bearings M4029 are each formed of, for example, sintered metal impregnated with a lubricant, such as oil. A carriage slider (CR slider) M4014 is provided at the portion of the carriage M4001 that contacts the carriage rail M4013. The carriage slider M4014 is a contact member formed of, for example, resin which provides high sliding performance and which has excellent wear resistance. It is constructed so as to allow, along with the CR bearings M4029, smooth scanning of the carriage M4001.

The carriage M4001 is secured to a carriage belt M4018 disposed in a tensioned state between an idler pulley M4020 (shown in FIG. 2) and a carriage motor pulley M4024 (also shown in FIG. 2) so as to be substantially parallel to the carriage shaft M4012. By moving the carriage motor pulley M4024 as a result of driving a carriage motor E0001 (shown in FIG. 14), and by moving the carriage belt M4018 forward or backward, the scanning of the carriage M4001 is carried out along the carriage shaft M4012. The carriage motor pulley M4024 is held in position by the chassis M3019. In contrast, the idler pulley M4020 is held so that it can move, along with the pulley holder M4021, with respect to the chassis M3019. In addition, the idler pulley M4020 is urged away from the motor pulley M4024 by a spring. Therefore, the carriage belt M4018 extending from the pulleys M4020 to M4024 is always under a proper tension, thereby allowing the carriage belt M4018 to be kept in a properly installed state without any bending therein.

The carriage belt M4018 and the carriage M4001 are mounted to each other at the mounting portion thereof by a carriage belt stopper M4019, whereby the carriage belt M4018 is reliably mounted to the carriage M4001.

In order to detect the amount of ink left in the ink tanks H1900 of the recording head cartridge H1000 carried by the carriage M4001, an ink end sensor E0006 (shown in FIG. 2) is provided on the portion of the spur stay M2006 where the path of scanning of the carriage M4001 lies such that it opposes and is exposed at the ink tanks H1900. The ink end sensor E0006 is held by an ink end sensor holder M4026, and is accommodated in an ink end sensor cover M4027 in order to block external noise. The ink end sensor cover M4027 includes, for example, a metallic plate for preventing, for example, malfunctioning of the sensor E0006.

Recovery Section

A description of the recovery section for performing a recovery operation on the recording head cartridge H1000 will now be given with reference to FIGS. 11 and 12.

The recovery section used in the embodiment comprises a recovery system unit M5000 independently and removably mounted to the printer body M1000. The recovery system unit M5000 comprises a cleaning means and a recovery means. The cleaning means is used to remove any foreign matter stuck on the recording element substrate 1100 of the recording head H1001. The recovery means is used to bring back the ink passage extending from the ink tanks H1900 to the recording element substrate 1100 of the recording head H1001 to the normal state.

Figure 11:
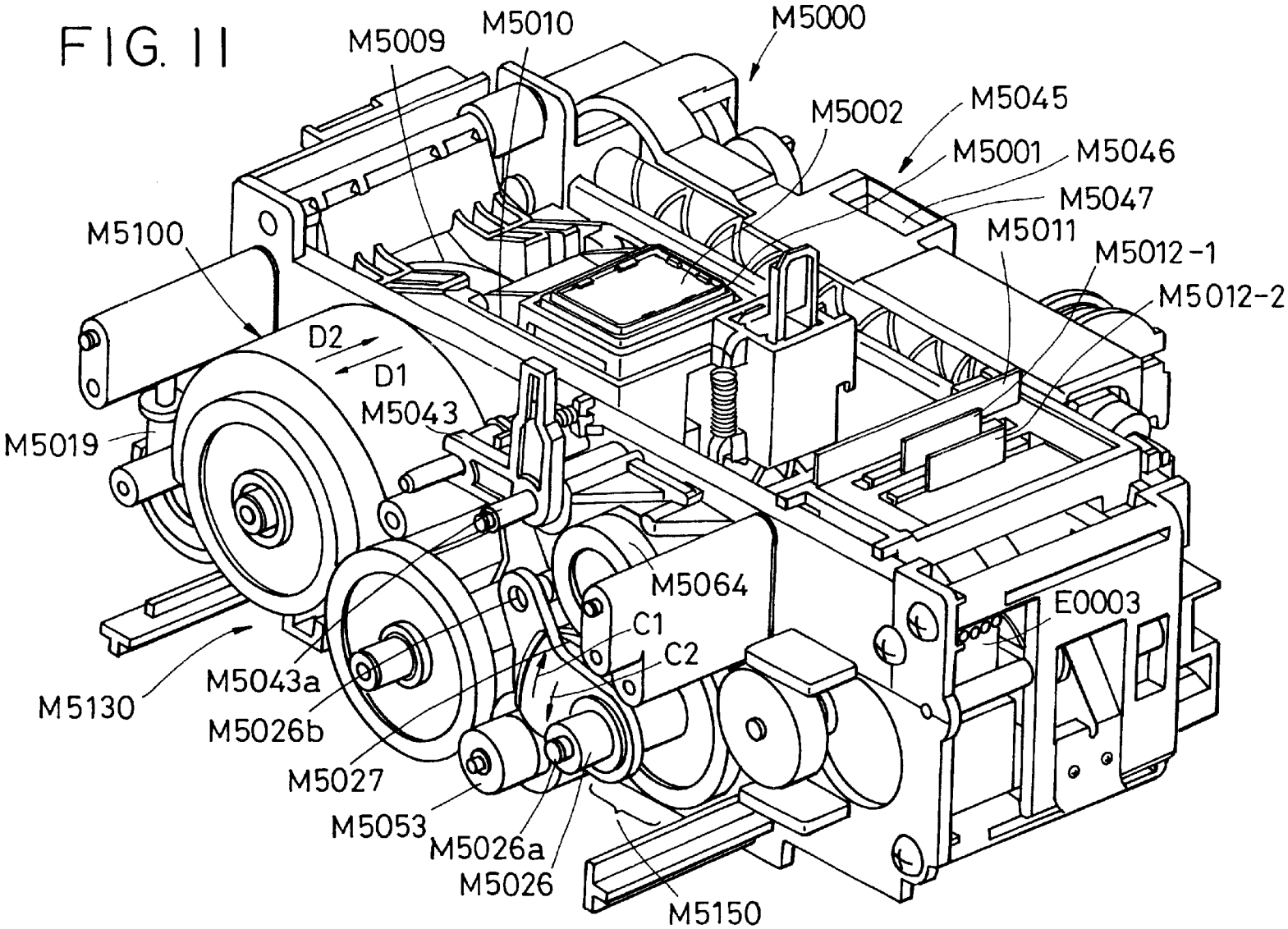
FIG. 11 is a perspective view of one side portion of a recovery system unit used in the embodiment of the present invention.
Figure 12:
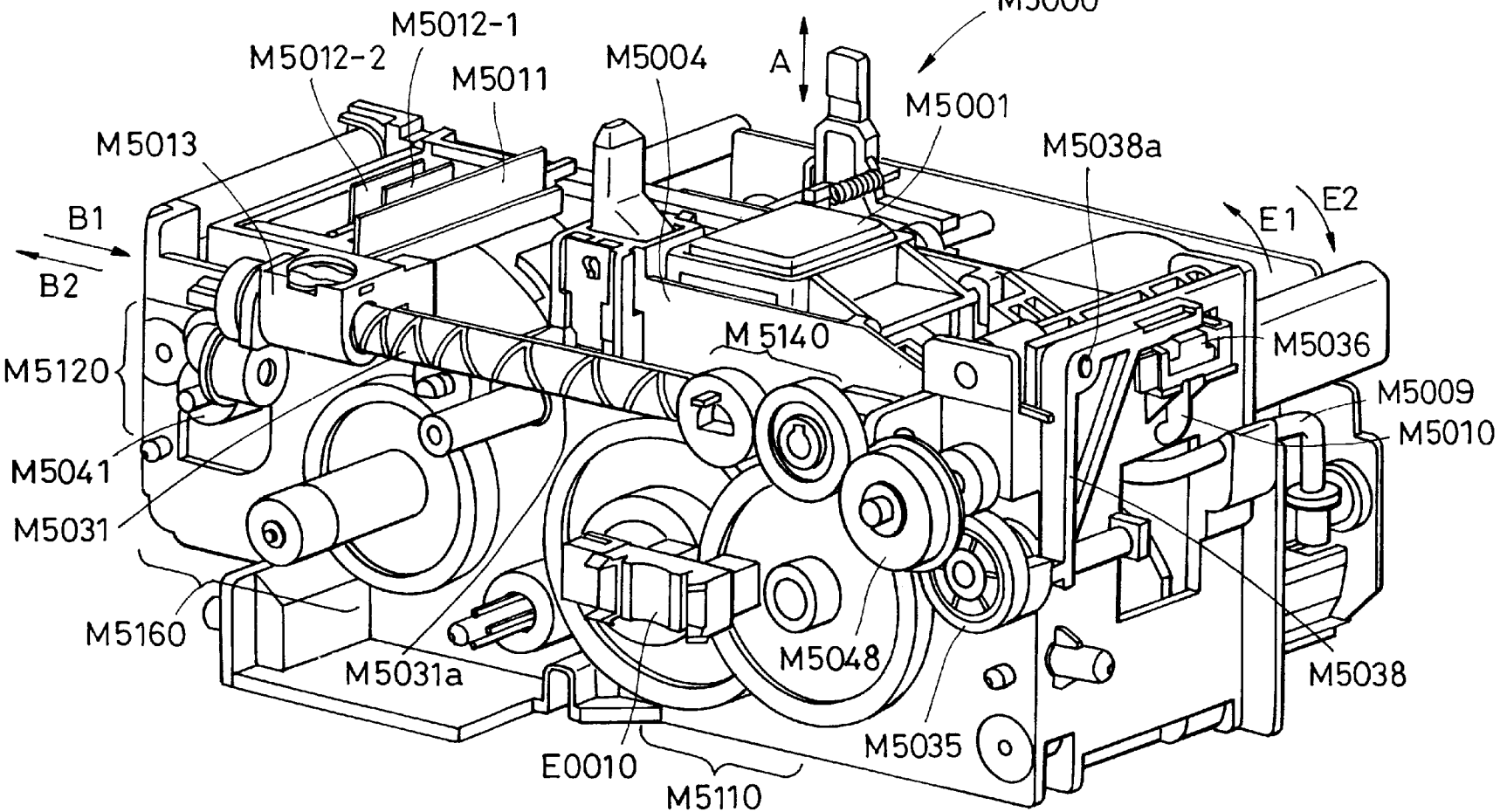
FIG. 12 is a perspective view of the other side portion of the recovery system unit shown in FIG. 11.

FIGS. 11 and 12 illustrate the PG motor E0003 which serves as a driving source for driving a cap M5001, a pump M5100, wiper blades M5011, M5012-1, and M5012-2, and the automatic sheet feed section M3022, all of which are described below. Driving power is extracted from both sides of the motor shaft of the PG motor E0003. One side of the motor shaft of the PG motor M0003 functions to drive either the pump M5100 or the automatic sheet feed section M3022 through a drive change-over means (described later), whereas the other side of the motor shaft of the PG motor M0003 functions to drive the cap M5001 and the wiper blades M5011, M5012-1, and M5012-2 which are connected together and move in response to each other's movement only when the PG motor E0003 rotates in a specified direction through a one-way clutch M5041. Hereunder, the specified direction of rotation is defined as the forward direction of rotation, while the direction of rotation opposite to the specified direction of rotation is defined as the backward direction of rotation. Accordingly, when the PG motor E0003 rotates in the backward direction, the one-way clutch M5041 is in idle operation, so that driving force is not transmitted. Consequently, the cap M5001, and the wiper blades M5011, M5012-1, and M5012-2 are not driven.

The cap M5001 is formed of rubber, with a cap lever M5004 being mounted thereto so as to be rotatable around the center of the axis thereof. The cap M5001 moves in the direction of arrow A (shown in FIG. 12) through the one-way clutch M5014, a cap drive transmission gear train M5110, a cap cam, and a cap lever M5004. The cap M5001 is constructed so that it can come into contact with and separate from the recording element substrate H1100 of the recording head H1001. A cap absorbing member M5002 is provided on the cap M5001, and is disposed so as to oppose the recording element substrate H1100 at a predetermined distance during a capping operation.

By disposing the cap absorbing member M5002, the ink discharged from the recording head cartridge H1000 can be received by the cap absorbing member M5002 when it absorbs the ink. Then, by an idle absorbing operation (described later), the ink in the cap M5001 can be completely discharged to a waste ink absorbing member. Two tubes, a cap tube M5009 and a valve tube M5010, are connected to the cap M5001. The cap tube M5009 is connected to a pump tube M5019 (described later) of the pump M5100, while the valve tube M5010 is connected to a valve rubber M5036 (described later).

The wiper blades M5011, M5012-1, and M5012-2 are flexible members formed of, for example, rubber. They are disposed in a standing manner on a blade holder M5013 so that edges thereof protrude upward therefrom. A lead screw M5031 is inserted into the blade holder M5013, and a protrusion (not shown) of the blade holder M5013 is movably fitted into a groove formed in the lead screw M5031. When the blade holder M5013 rotates in accordance with the rotation of the lead screw M5031, it reciprocates along the lead screw M5031 in the directions of arrows B1 and B2 (shown in FIG. 12). As the blade holder M5013 reciprocates, the wiper blades M5011, M5012-1, and M5012-2 wipe and clean the recording element substrate H1100 of the recording head cartridge H1000. The lead screw M5031 is connected to the PG motor E0003 through the one-way clutch M5041 and the wiper drive transmission gear train M5120.

A pump M5100 is provided to produce pressure by making a roller (not shown) move over the pump tube M5019. The pump M5100 is connected to the other side of the PG motor E0003 through the drive change-over means and the pump drive transmission gear train M5130. The drive change-over means performs a switching operation between passages for transmitting driving power to the automatic sheet feed section M3022 and to the pump M5100. A mechanism (not described in detail) for removing press-contact force of the roller (not shown) on the pump tube M5019 produced as a result of the roller pressing on the pump tube M5019 is provided at the pump M5100. The mechanism is constructed such that, when the PG motor E0003 rotates in the forward direction, the press-contact force of the roller is removed so that the roller move over the pump tube M5019, whereas, when the PG motor E0003 rotates in the backward direction, the press-contact force of the roller acts on the pump tube M5019 so that the roller moves over the pump tube M5019. One end of the pump tube M5019 is connected to the cap M5001 through the cap tube M5009.

The drive change-over means comprises a pendulum arm M5026 and a change-over lever M5043. The pendulum arm M5026 is constructed so as to be rotatable around an axis M5026*a* as center in the direction of arrow C1 or arrow C2 (shown in FIG. 11) in accordance with the direction of rotation of the PG motor E0003. The change-over lever M5043 switches position based on the position of the carriage M4001. More specifically, the change-over lever M5043 is constructed so that, when the carriage M4001 moves above the recovery system unit M5000, a portion of the change-over lever M5043 comes into contact with a portion of the carriage M4001, whereas, when the change-over lever M5043 moves in the direction of arrow D1 or arrow D2 (shown in FIG. 11) in accordance with the position of the carriage M4001, a lock hole M5026*b* formed in the pendulum arm M5026 and a lock pin M5043*a* of the change-over lever M5043 are fitted together.

One end of the valve tube M5010 is connected to the cap M5001, whereas the other end of the valve tube M5010 is connected to the valve rubber M5036. The valve rubber M5036 is connected to the discharge roller M2003 (shown in FIG. 5) through the valve cam M5035, the valve clutch M5048, and the valve drive transmission gear train M5140. The valve lever M5038 which can rotate in the direction of either arrow E1 or arrow E2 around an axis M5038*a* as center in accordance with the rotation of the discharge roller M2003 is disposed so that it can come into contact with and separate from the valve rubber M5036. When the valve lever M5038 is in contact with the valve rubber M5036, the valve rubber M5036 is in a closed state, whereas, when the valve lever M5038 is separated from the valve rubber M5036, the valve rubber M5036 is in an open state.

A PG sensor E0010 for detecting the position of the cap M5001 is provided.

A description of the operation of the recovery system unit M5000 having the above-described structure will now be given.

First, the driving operation of the automatic sheet feed section M3022 is described.

When the PG motor E0003 rotates in the backward direction when the carriage M4001 is in a position where it is separated from the change-over lever M5043, the pendulum arm M5026 is swung in the direction of arrow C1 (shown in FIG. 11) through a pendulum drive transmission gear train M5150, causing a change-over output gear M5027 mounted on the pendulum arm M5026 to be fitted to an ASF gear 1 M5064 disposed at one end of an ASF drive transmission gear train M5160. When, in this state, the PG motor E0003 continues rotating in the backward direction, the automatic sheet feed section M3022 is driven through the ASF drive transmission gear train M5160. At this time, since the one-way clutch M5041 is in idle operation, driving force is not transmitted to the cap M5001 and the wiper blades M5011, M5012-1, and M5012-2, so that the wiper blades M5011, M5012-1, and M5012-2 do not operate.

A description of the absorbing operation of the pump M5100 will now be given.

When the PG motor E0003 rotates in the forward direction when the carriage M4001 is in the position where it is separated from the change-over lever M5043, the pendulum arm M5026 is swung in the direction of arrow C2 through the pendulum drive transmission gear train M5150, causing the change-over output gear M5027 mounted on the pendulum arm M5026 to be fitted to the pump gear 1 M5053 disposed at one end of the pump drive transmission gear train M5130.

Thereafter, when the carriage M4001 moves to a capping position (that is, the position of the carriage M4001 where the recording element substrate H1100 of the recording head cartridge H1000 opposes the cap M5001), a portion of the carriage M4001 comes into contact with a portion of the change-over lever M5043, causing the change-over lever M5043 to move in the direction of arrow D1. This causes the lock pin M5043*a* of the change-over lever M5043 to be fitted into the lock hole M5026*b* of the pendulum arm M5026, so that the pendulum arm M5026 is locked while it is in a connected state at the pump M5001 side.

Here, when the discharge roller M2003 is driven in the backward direction, the valve lever M5038 rotates in the direction of arrow E1, causing the valve rubber M5036 to be in an open state. In the open state, the PG motor E0003 rotates in the forward direction, and drives the cap M5001 and the wiper blades M5011, M5012-1, and M5012-2, causing the cap M5001 to come into intimate contact with and cover the recording element substrate H1100 of the recording head 1001. Here, the pump M5100 operates, but, since press-contact force is not applied to the pump tube M5019 by the roller (not shown), the roller does not move over the pump tube M5019, so that no pressure is produced.

When the discharge roller M2003 is driven in the forward direction, causing the valve lever M5038 to rotate in the direction of arrow E2 (shown in FIG. 12), the valve rubber M5036 is brought into a closed state. Here, when the PG motor E0003 rotates in the backward direction, causing the roller to move over the pump tube M5019 while applying a press-contact force thereto, a negative pressure acts on the recording element substrate H1100 of the recording head cartridge H1000 through the cap tube M5009 and the cap M5001. The negative pressure causes, for example, bubbles and ink that is no longer suitable as recording ink to be forcingly absorbed from the discharge openings H1100T formed in the recording element substrate H1100.

Thereafter, when the discharge roller M2003 is driven in the backward direction while the PG motor E0003 rotates in the backward direction, the valve lever M5038 rotates in the direction of arrow E1 (shown in FIG. 12), causing the valve rubber M5036 to be in an open state. As a result, the pressure in the pump tube M5019, the cap tube M5009, and the cap M5001 becomes large, causing the forced absorption of, for example, ink from the ink discharge openings in the recording element substrate H1100 of the recording head cartridge H1000 to stop. At the same time, the ink which fills the pump tube M5019, the cap tube M5009, and the cap M5001 is absorbed, and is discharged to the waste ink absorbing member (not shown) from the other end of the pump tube M5019. This will hereinafter be called idle sucking. Here, the PG motor E0003 stops moving, causing the discharge roller M2003 to be driven in the forward direction. When this causes the valve lever M5038 to rotate in the direction of arrow E2 (shown in FIG. 12), the valve rubber M5306 is brought into a closed state, whereby the absorbing operation ends.

A description of the wiping operation will now be given.

In the wiping operation, the PG motor E0003 rotates in the forward direction, causing the wiper blades M5011, M5012-1, and M5012-2 to move to a wiping start position. When the wiper blades M5011, M5012-1, and M5012-2 are at the wiping start position, they are situated upstream from the recording head cartridge H1000 during a recording operation while the cap M5001 is separated from the recording head cartridge H1000. Then, the carriage M4001 moves to a wiping position where the wiper blades M5011, M5012-1, and M5012-2 oppose the recording element substrate H1100. Here, the carriage M4001 and the change-over lever M5043 are not in contact with each other, so that the pendulum arm M5026 is not in a locked state.

Here, the PG motor E0003 rotates in the forward direction in order to wipe and clean the recording element substrate H1100 of the recording head cartridge H1000 while the wiper blades M5011, M5012-1, and M5012-2 move in the direction of arrow B1 (as shown in FIG. 12). The recording element substrate H1100 is further wiped and cleaned by a wiping blade cleaning means (not shown, but described later), whereby stains on the wiper blades M5011, M5012-1, and M5012-2 are removed. The wiping blade cleaning means is disposed downstream from the recording element substrate H1100 of the recording head cartridge H1000 in the direction of the recording operation. Here, the cap M5001 is kept separated from the recording element substrate H1100.

When the PG motor E0003 stops when the wiper blades M5011, M5012-1, and M5012-2 reach a wiping termination position (that is, a downstream termination position in a recording operation), the carriage M4001 moves to a location outside the area of movement of the wiper blades M5011, M5012-1, and M5012-2. The PG motor E0003 rotates in the forward direction, causing the wiper blades M5011, M5012-1, and M5012-2 to move to the wiping termination position. At this time, the cap M5001 is kept separated from the recording element substrate H1100. After the movement to the wiping termination location, the wiping operation is completed.

A description of a preliminary discharge operation will now be given.

When the above-described absorbing operation and wiping operation are carried out using the recording head H1000 which discharges ink of a plurality of colors, the problem that the ink gets mixed arises.

This problem arises, for example, when ink sucked out from an ink discharge opening enter an ink discharge opening containing ink of another color by the absorbing operation, or when ink types of various colors are wiped such that ink of a certain color from the ink discharge opening corresponding thereto is pushed into an ink discharge opening containing ink of a different color. In such a case, when the next recording operation is started, the first portion that is recorded may change color (that is, color mixing may occur in the first portion that is recorded), so that the image may become deteriorated.

To prevent color mixing, a preliminary discharge operation of the mixed ink is previously discharged just before recording. In the embodiment, as shown in FIG. 11, a preliminary discharge opening M5045 is disposed near the cap M5001. The preliminary discharge operation is achieved by moving the recording element substrate H1100 of the recording head H1000 just before recording so that it opposes the preliminary discharge opening M5045.

The preliminary discharge opening M5045 is formed by a preliminary discharge absorbing member M5046 and a preliminary discharge cover M5047. The preliminary discharge absorbing member M5046 is connected to the waste ink absorbing member (not shown).

Scanner

Figure 13B:
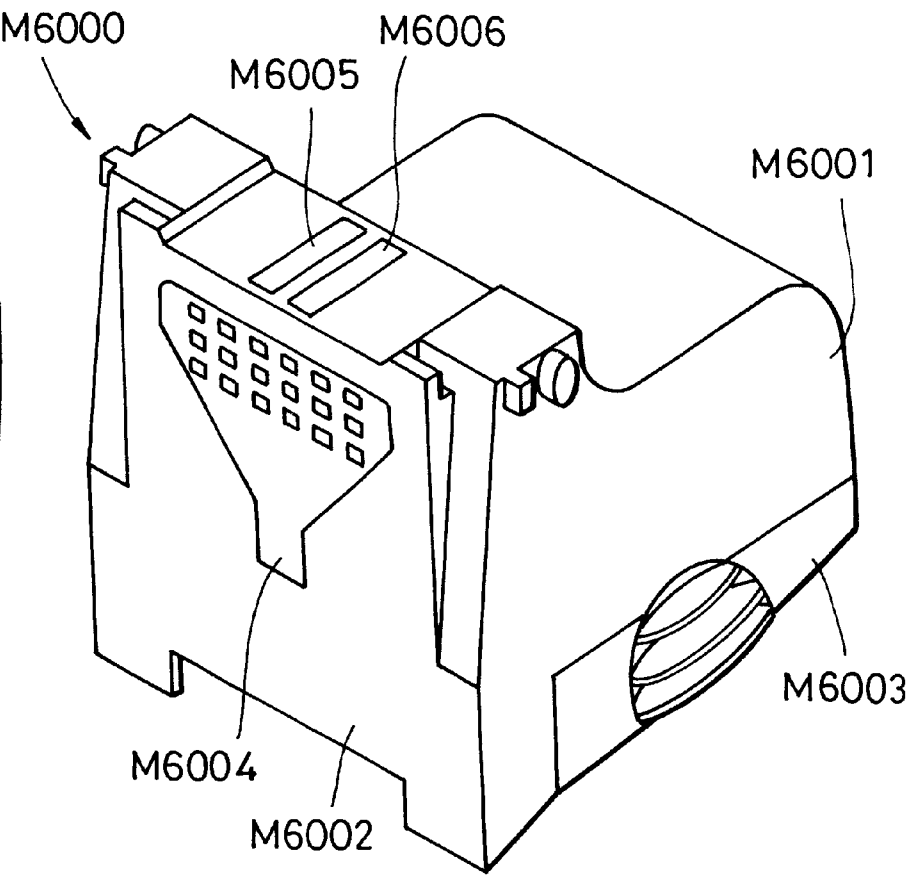
FIGS. 13A and 13B are perspective views of a scanner cartridge used in the embodiment of the present invention.
Figure 13A:
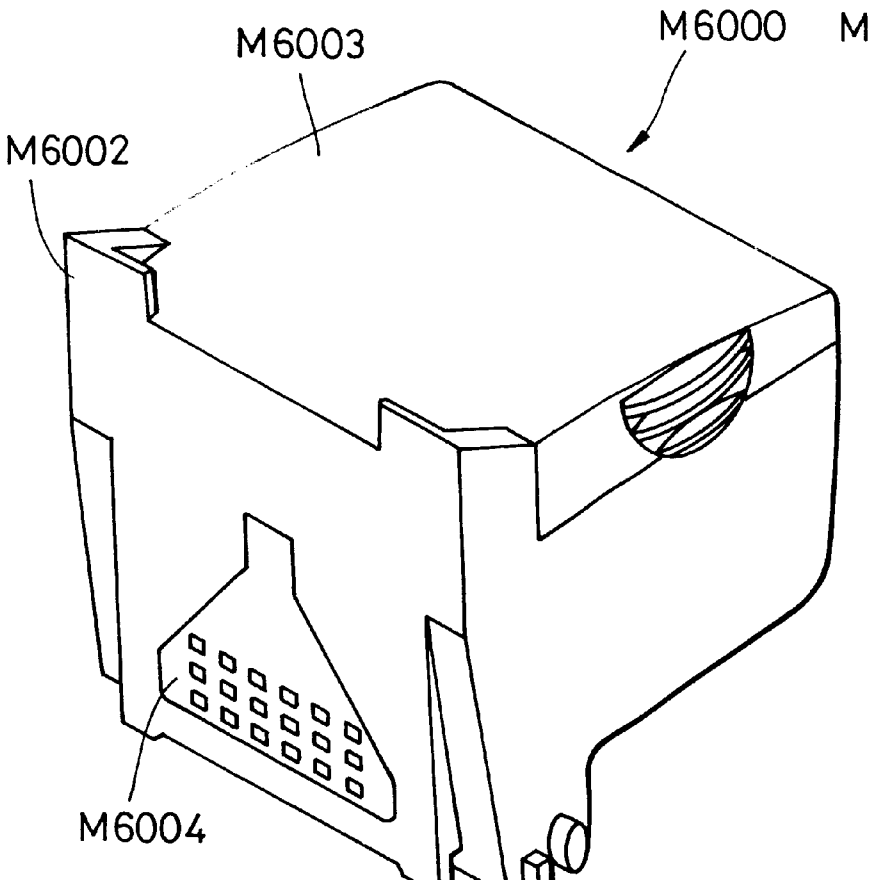

The printer of the embodiment can also be used as a reader by replacing the recording head with a scanner such as that shown in FIGS. 13A and 13B.

The scanner moves along with the carriage M4001 of the printer in order to read in a subscanning direction the image on an original that has been transported in place of a recording medium. By alternately carrying out the reading operation and the original transporting operation, the image information of one original is read.

FIGS. 13A and 13B schematically illustrate the structure of a scanner M6000.

As shown in FIGS. 13A and 13B, a scanner holder M6001 has the shape of a box, and accommodates in its interior optical systems, processing circuits, etc., needed to carry out a reading operation. When the scanner M6000 is mounted to the carriage M4001, a scanner reading lens M6006 is provided on the portion of the scanner M6000 opposing the surface of an original. A scanner illuminating lens M6005 incorporates a light source (not shown) in its interior. Light is emitted from the light source to irradiate the original.

A scanner cover M6003 affixed to the bottom portion of the scanner holder M6001 is fitted thereto so as to shield the interior of the scanner holder M6001 from light. A louver-type gripping section provided at a side surface of the scanner cover M6003 makes it easier to mount it to and remove it from the carriage M4001. The external shape of the scanner holder M6001 is substantially the same as the external shape of the recording head H1001. The scanner holder M6001 can be mounted to and removed from the carriage M4001 in the same way as the recording head cartridge H1000.

A substrate having the aforementioned processing circuits formed thereon is accommodated in the scanner holder M6001. A scanner contact PCB M6004 connected to the substrate is provided so as to be exposed to the outside. When the scanner M6000 is mounted to the carriage M4001, the scanner contact PCB M6004 comes into contact with the contact FPC E0011 of the carriage M4001, and the substrate is such as to be electrically connected to a controlling system of the body M1000 through the carriage M4001.

Storage Box

Figure 14:
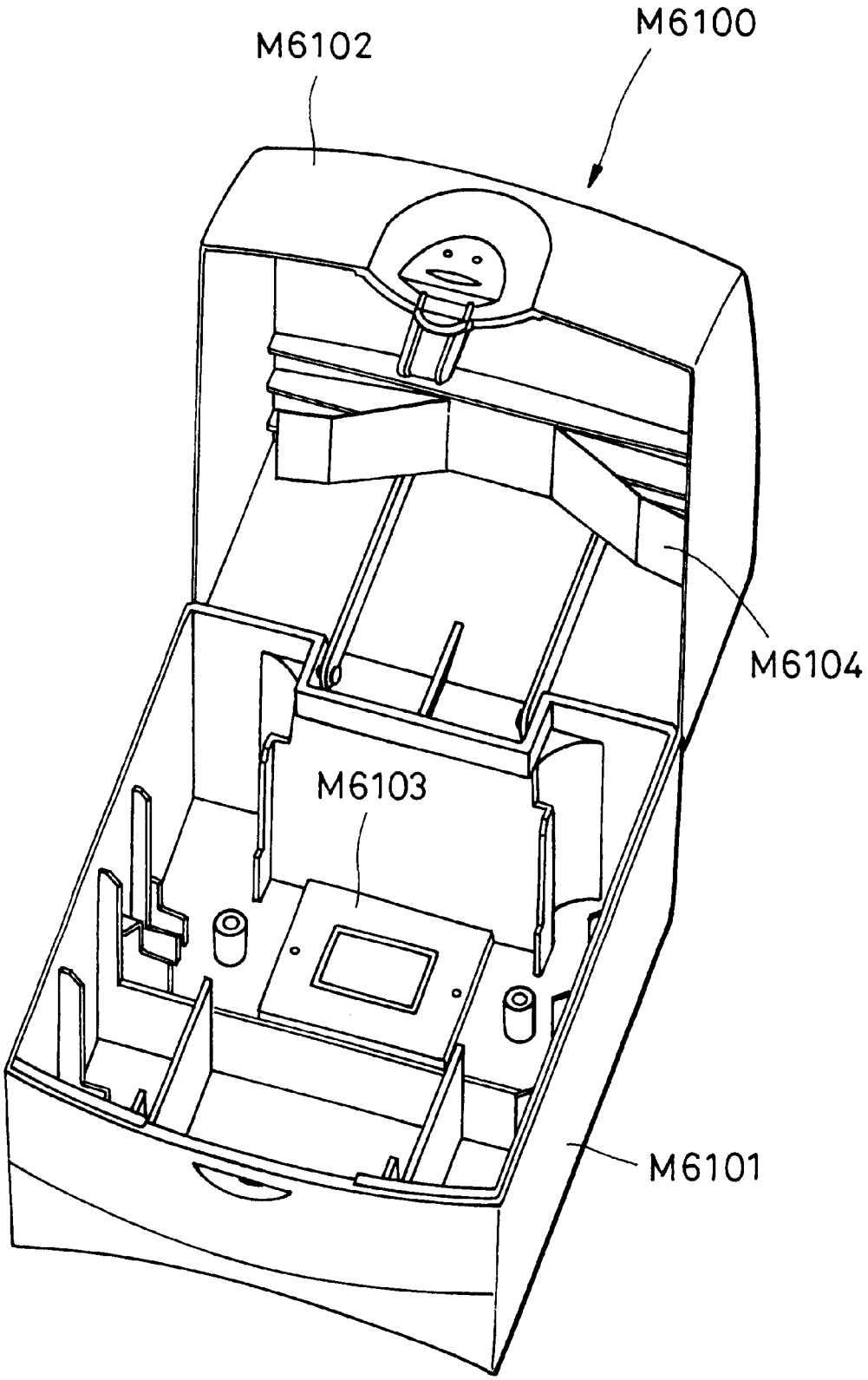
FIG. 14 is a perspective view of a storage box used in the embodiment of the present invention.

FIG. 14 illustrates a storage box M6100 for storing the recording head H1001.

The storage box M6100 comprises a base M6101, a cover M6102, a cap M6103, and a spring M6104. The base M6101 has an open top. The cover M6102 is rotatably attached to the base M6101 so that the opening can be covered and uncovered. The cap M6103 is secured to the bottom portion of the base M6101. The spring M6104 is a plate spring secured to the top inside surface of the cover M6102.

When the recording head is to be stored in the storage box M6100 having the above-described structure, the recording head H1001 is inserted into the base M6101 so that the nozzle opposes the cap M6103. The cover M6102 is closed, and a stopper section of the base M6101 is brought into engagement with the cover M6102 in order to keep the cover M6102 in a closed state. In the closed state, the spring M6104 presses the recording head H1001, so that the nozzle of the recording head H1001 is hermetically covered by the cap M6103. Accordingly, the storage box M6100 can store the recording head H1001 while preventing dust from sticking onto the nozzle and ink from evaporating. Consequently, the recording head H1001 can be kept in good condition for a long period of time.

The storage box M6100 for storing the recording head H1001 can also be used to store the scanner M6000. However, ink is stuck on the storage box cap M6103 used for protecting the nozzle of the recording head H1001. Therefore, in order to prevent the cap M6103 from contacting the scanner M6000, the surface of the scanner M6000 where the scanner reading lens M6006 and the scanner illuminating lens M6005 are formed must be accommodated so as to face a direction further away from the cap M6103 than the plane including the nozzle of the recording head H1001.

A description of the structure of an electrical circuit used in this embodiment of the present invention will now be given.

Figure 15:
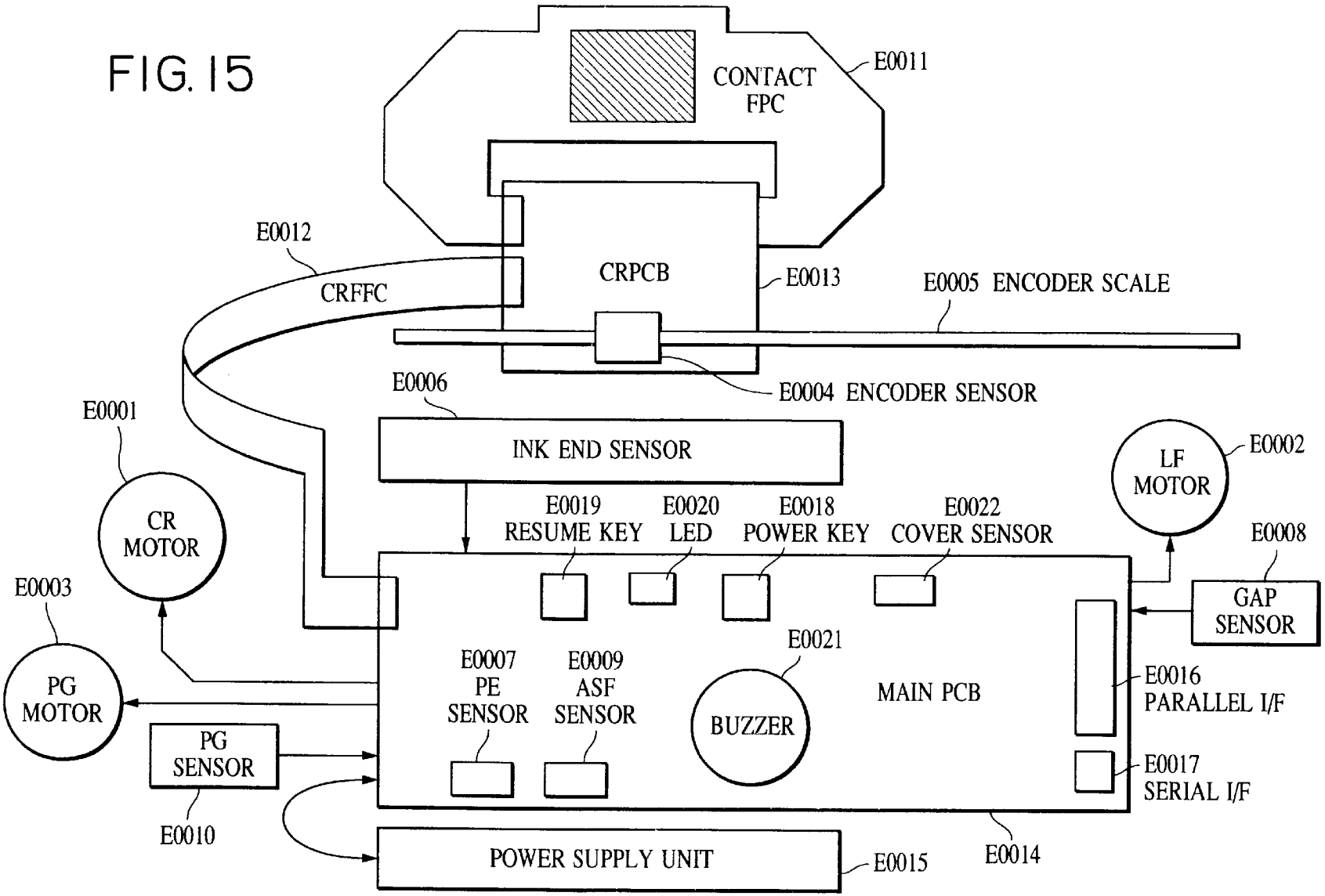
FIG. 15 is a block diagram schematically illustrating the entire structure of an electrical circuit used in the embodiment of the present invention.

FIG. 15 schematically illustrates the entire structure of the electrical circuit used in this embodiment of the present invention.

The electrical circuit primarily comprises a carriage board (CRPCB) E0013, a main printed circuit board (main PCB) E0014, and an electrical power unit E0015.

The electrical power unit E0015 is connected to the main PCB E0014 in order to provide various driving power supplies.

The carriage board E0013 is a printed board unit placed on the carriage M4001 (see FIG. 2). The carriage board E0013 functions as an interface for transmitting and receiving a signal to and from the recording head H1001 through the contact FPC E0011. In addition, based on a pulse signal output from the encoder sensor E0004 as a result of the movement of the carriage M4001, the carriage board E0013 detects any change in the positions of the encoder scale E0005 and the encoder sensor E0004 relative to each other, and outputs the output pulse signal to the main PCB E0014 through the flexible flat cable (CRFFC) E0012.

The main PCB E0014 controls the driving operation of each component part of the inkjet recording device of the embodiment of the present invention. It includes an I/O port in the substrate for a sheet end detecting sensor (PE sensor) E0007, an ASF sensor E0009, a cover sensor E0022, a parallel interface (parallel I/F) E0016, a serial interface (serial I/F) E0017, a resume key E0019, a light emitting diode (LED) E0020, a power key E0018, and a buzzer E0021. It is connected to the CR motor E0001, the LF motor E0002, and the PG motor E0003 in order to control the driving of these motors E0001 to E0003. It includes an interface for connection with the ink end sensor E0006, the GAP sensor E0008, the PG sensor E0010, the CRFFC E0012, and the power unit E0015.

Figure 16:
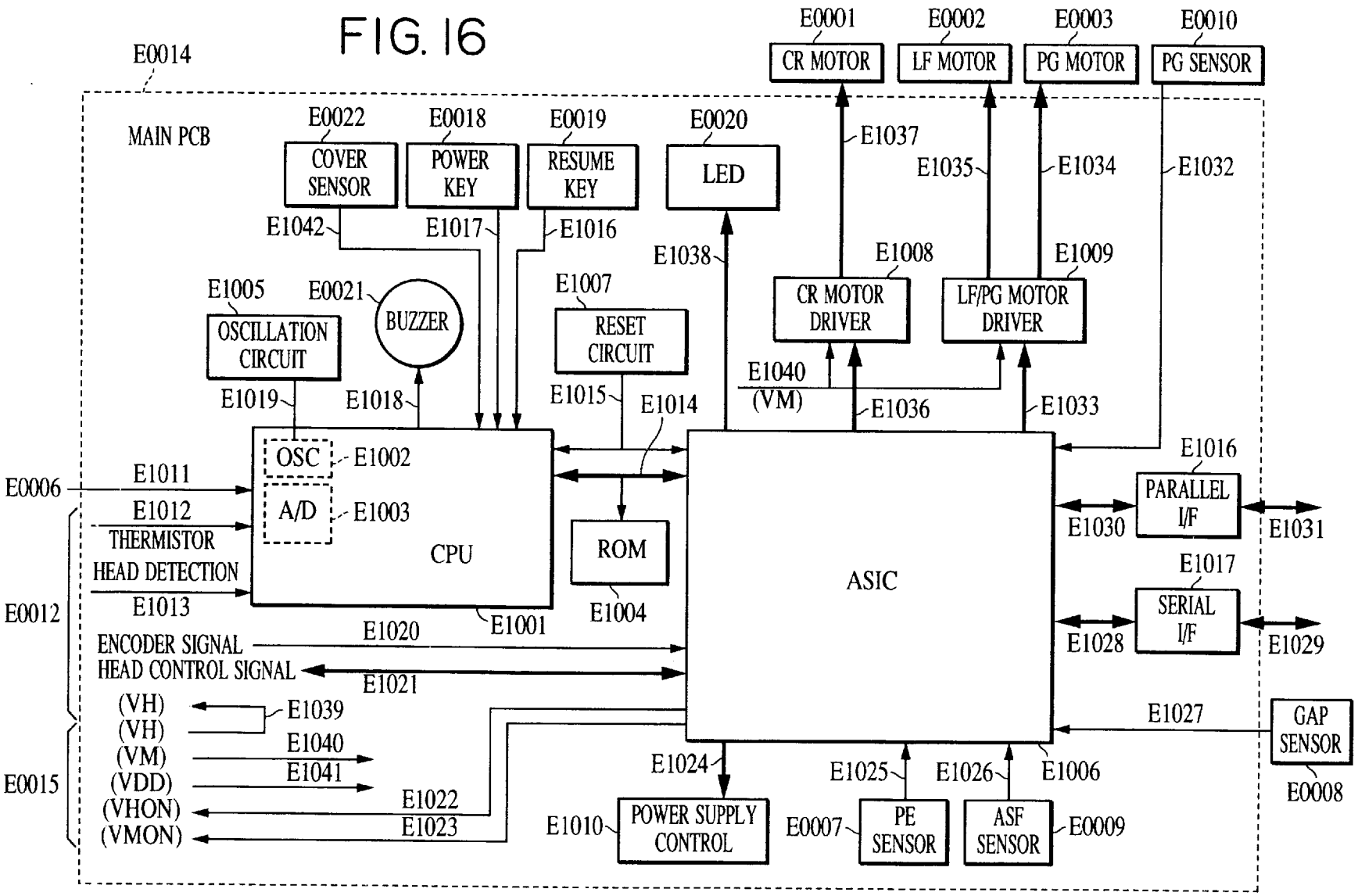
FIG. 16 is a block diagram illustrating the internal structure of a main PCB shown in FIG. 15.

FIG. 16 is a block diagram illustrating the internal structure of the main PCB E0014.

In FIG. 16, a central processing unit (CPU) E1001 includes an oscillator (OSC) E1002 in its interior. The oscillator E1002 is connected to an oscillation circuit E1005 in order to generate a system clock signal by an output signal E1019. Through a control bus E1014, the central processing unit E1001 is connected to a read only memory (ROM) E1004 and an application specific integrated circuit (ASIC) E1006. In accordance with the program stored in ROM E1004, it controls the ASIC E1006, and detects the states of an input signal E1017 from the power key E0018, an input signal E1016 from the resume key E0019, a cover detection signal E1042, and a head detection signal (HSENS) E1013. In addition, it drives the buzzer E0021 by a buzzer signal (BUZ) E1018, and detects the states of an ink end detection signal (INKS) E1011 and a thermistor temperature detection signal (TH) E1012 linked to an analog-to-digital (A/D) converter incorporated in the central processing unit E1001. Further, it controls the driving operation of the inkjet recording device by performing various logical operations, determining conditions, etc.

The head detection signal E1013 is a head loading detection signal input from the recording head cartridge H1000 through the flexible flat cable E0012, the carriage board E0013, and the contact flexible print cable E0011. The ink end detection signal E1011 is an analog signal output from the ink end sensor E0006. The thermistor temperature detection signal E1012 is an analog signal from a thermistor (not shown) provided on the carriage board E0013.

A CR motor driver E1008 uses a motor power supply (VM) E1040 as a driving source. In accordance with a CR motor control signal E1036 from the ASIC E1006, the CR motor driver E1008 generates a CR motor drive signal E1037 in order to drive the CR motor E0001. An LF/PG motor driver E1009 uses the motor power supply E1040 as a driving source. In accordance with a pulse motor control signal (that is, a PM control signal) E1033 from the ASIC E1006, the LF/PG motor driver E1009 generates an LF motor drive signal E1035 in order to drive the LF motor E0002, and generates a PG motor drive signal E1034 in order to drive the PG motor E0003.

A power supply control circuit E1010 controls the electrical power supply to, for example, each of the sensors including a light-emitting element in accordance with a power supply control signal E1024 from the ASIC E1006. The parallel I/F E0016 transmits a parallel I/F signal E1030 from the ASIC E1006 to a parallel I/F cable E1031 connected to an external device. It also transmits a signal from the parallel I/F cable E1031 to the ASIC E1006. The serial I/F E0017 transmits a serial I/F signal E1028 from the ASIC E1006 to a serial I/F cable E1029 connected to an external device. It also transmits a signal from the cable E1029 to the ASIC E1006.

The power source unit E0015 provides a head power source (VH) E1039, a motor power source (VM) E1040, and logic power source (VDD) E1041. From the ASIC E1006, a head power supply ON signal (VHON) E1022 and a motor power supply ON signal (VMOM) E1023 are input to the power supply unit E0015 in order to turn the head power supply E1039 and the motor power supply E1040 on and off. When the voltage is converted as required, the logic power supply (VDD) E1041 provided by the power supply unit E0015 supplies electrical power to each of the component parts inside and outside the main PCB E0014.

After the voltage from the head power supply E1039 has been made smooth on the main PCB E0014, it is sent to the flexible flat cable E0011, and is used to drive the recording head cartridge H1000.

A reset circuit E1007 detects any drop in a logic power supply voltage E1040 in order to supply a reset signal E1015 to the CPU E1001 and the ASIC E1006 for performing initialization.

The ASIC E1006 is a one-chip semiconductor integrated circuit, and is controlled by the CPU E1001 through the control bus E1014. It outputs the CR motor control signal E1036, the PM control signal E1033, the power supply control signal E1024, the head power supply ON signal E1022, the motor power supply ON signal E1023, etc., and transmits and receives signals to and from the parallel I/F E0016 and the serial I/F E0017. In addition, it detects the states of a PE detection signal (PES) E1025 from the PE sensor E0007, an ASF detection signal (ASFS) E1026 from the ASF sensor E0009, a GAP detection signal (GAPS) E1027 from the GAP sensor E0008, and a PG detection signal (PGS) E1032 from the PG sensor E0010. Pieces of data which indicate the states thereof are transmitted to the CPU E1001 through the control bus E1014, and, based on the input pieces of data, the CPU E1001 controls the driving by a driving signal E1038 in order to make the LED E0020 flash.

The ASIC E1006 also detects the state of an encoder signal (ENC) E1020 in order to generate a timing signal. When the timing signal is generated, interfacing with the recording head cartridge H1000 is carried out by the head control signal E1021 to control the recording operation. Here, the encoder signal (ENC) E1020 is an output signal of the CR encoder sensor E0004 input through the flexible flat cable E0012. The head control signal E1021 is supplied to the recording head H1001 through the flexible flat cable E0012, the carriage board E0013, and the contact FPC E0011.

Figure 17:
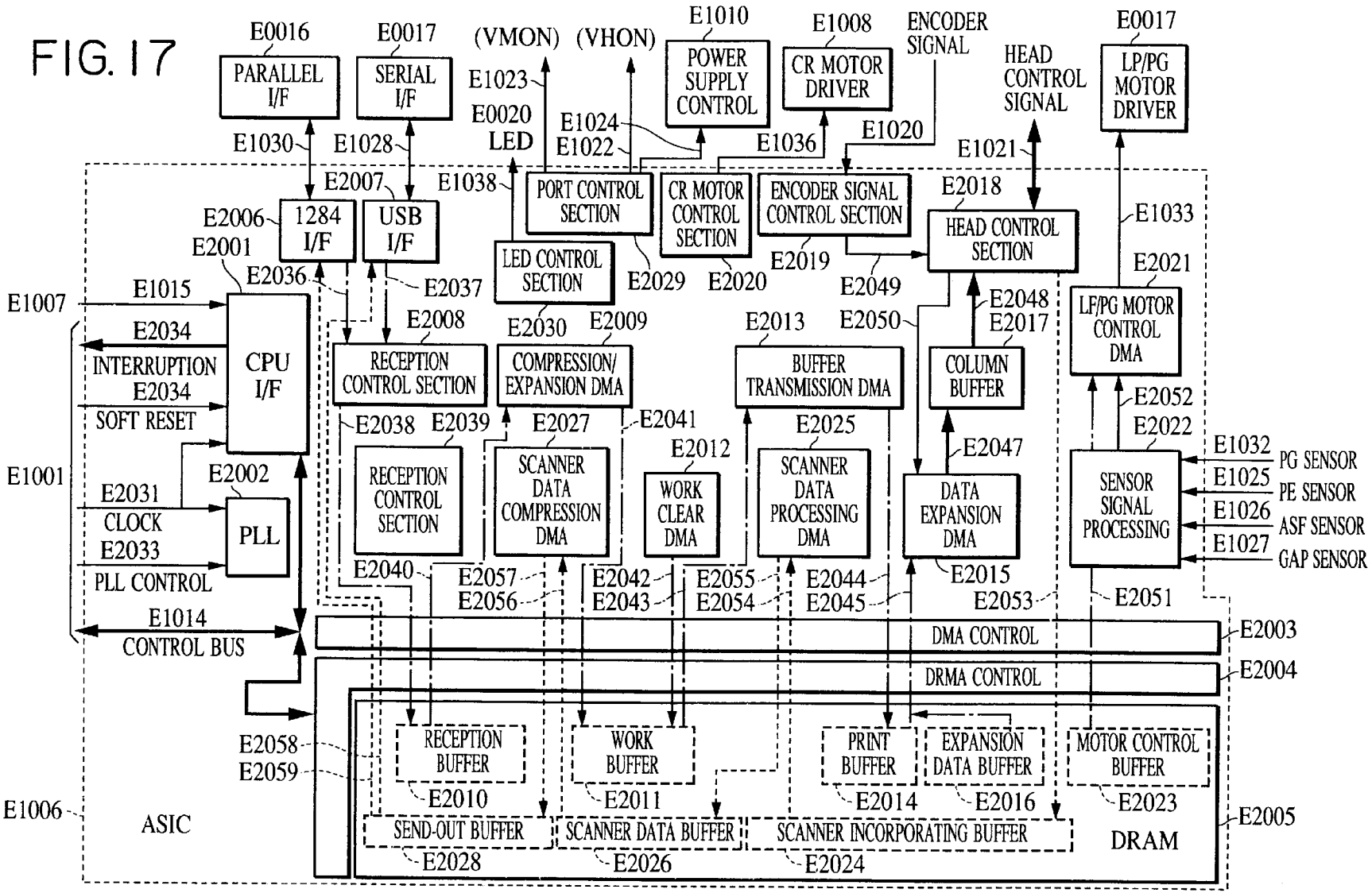
FIG. 17 is a block diagram illustrating the internal structure of an ASIC shown in FIG. 16.

FIG. 17 is a block diagram of the internal structure of the ASIC E1006.

In FIG. 17, only the flow of data regarding the controlling of the head and each of the mechanical parts, such as recording data and motor controlling data, are shown between the blocks. To simplify the drawing, a clock and a control signal regarding the reading and writing of data from and to a register incorporated in each block, a control signal regarding a DMA controlling operation, etc., are not shown.

In FIG. 17, by a PLL control signal (PLLON) E2033 and a clock signal (CLK) E2031 output from the CPU E1001 shown in FIG. 16, a PLL E2002 generates a clock signal (not shown) supplied to a large portion of the interior of the ASIC E1006.

By a soft reset signal (PDWN) E2032 and the clock signal (CLK) E2031 output from the CPU E1001 and a control signal from the control bus E1014, a CPU interface (CPUI/F) E2001 controls, for example, the reading and writing of data from and to the register in each block, supplies clock signals to and receives interruption signals from some of the blocks. The supplying of the clock signals and the interruption signals are not illustrated. The CPU interface E2001 outputs an interruption signal (INT) E2034 to the CPU E1001 to indicate to the user that an interruption has occurred in the ASIC E1006.

A dynamic random access memory (DRAM) E2005 includes as recording data buffers a reception buffer E2010, a work buffer E2011, a print buffer E2014, and an expansion data buffer E2016. In addition, it includes a motor control buffer E2023 for a motor controlling operation. Further, it includes a scanner incorporating buffer E2024, a scanner data buffer E2026, and a send-out buffer E2028, which are used instead of the recording data buffers during a scanner operation mode.

The DRAM E2005 is also used as a work area required for the operation of the CPU E1001. A DRAM control section E2004 performs a reading operation and a writing operation on the DRAM E2005 as a result of a switching operation between access to the DRAM E2005 from the CPU E1001 by the control bus E1014 and access to the DRAM E2005 from a DMA control section E2003 (described later).

A request (not shown) is received from each block by the DMA control section E2003 in order to output an address signal and a control signal (not shown), pieces of write data (E2038, E2041, E2044, E2053, E2055, and E2057) when a write operation is carried out, etc., to the DRAM control section E2004 in order to access the DRAM E2005. When data is to be read out, pieces of readout data (E2040, E2043, E2045, E2051, E2054, E2056, E2058, and E2059) are transferred to each block (source of request) from the DRAM control section E2004.

By a controlling operation of the CPU E1001 through the CPUI/F E2001, a 1284 interface (I/F) E2006 performs a bidirectional communications interfacing with an external host device (not shown) through the parallel I/F E0016. During a recording operation, the 1284 interface (I/F) E2006 transfers reception data (that is, PIF reception data E2036) from the parallel I/F E0016 to a reception control section E2008 by a DMA operation. On the other hand, during a scanner reading operation, data stored in the send-out buffer E2028 in the DRAM E2005 (that is, 1284 transmission data (RDPIF) E2059) is transmitted to the parallel I/F by a DMA operation.

By a controlling operation of the CPU E1001 through the CPU I/F E2001, a USB interface (USBI/F) E2007 performs bidirectional communications interfacing with an external host device (not shown) through the serial I/F E0017. During a printing operation, the USBI/F E2007 transfers reception data (that is, USB reception data E2037) from the serial I/F E0017 to the reception control section E2008 by a DMA operation. On the other hand, during a scanner reading operation, data stored in the send-out buffer E2028 in the DRAM E2005 (that is USB transmission data (RDUSB) E2058) is sent to the serial I/F E0017 by a DMA operation. The reception control section E2008 writes reception data (that is, (WDIF) E2038) from either one of the 1284 I/F E2006 and the USB I/F E2007 into a reception buffer write address location controlled by a reception buffer control section E2039.

By a controlling operation of the CPU E1001 through the CPUI/F E2001, a compression/expansion DMA section E2009 reads out reception data (that is, raster data) stored in the reception buffer E2010 from the reception buffer readout address location controlled by the reception buffer control section E2039. Then, in accordance with the specified mode, this data (or data (RDWK) E2040) is compressed or expanded, and is written as a recording code row (WDWK) E2041 to the work buffer area.

By a controlling operation of the CPU E1001 through the CPUI/F E2001, a recording buffer transfer DMA section E2013 reads out a recording code (RDWP) E2043 in the work buffer E2011, rearranges the recording codes in address locations in the print buffer E2014 in an order suitable for data transfer to the recording head cartridge H1000, and transfers the recording codes (WDWP E2044). By a controlling operation of the CPU E1001 through the CPUI/F E2001, a work clear DMA section E2012 repeatedly writes specified work fill data (WDWF) E2042 to areas of the work buffer E2011 after completion of data transfer by a recording buffer transfer DMA section E2015.

By a controlling operation of the CPU E1001 through the CPUI/F E2001, a recording data expansion DMA section E2015 is triggered by a data expansion timing signal E2050 from a head control section E2018 to read out recording codes rearranged and written to the print buffer E2014 and expansion data written to the expansion data buffer E2016. Then, expansion recording data (RDHDG) E2045 is generated, and is written as column buffer write data (WDHDG) E2047 to a column buffer E2017. Here, the column buffer E2017 is static access memory (SRAM) which temporarily stores expansion recording data to be transferred to the recording head cartridge H1000, and is commonly controlled by the recording data expansion DMA section E2015 block and the head control section E2018 block by a hand-shake signal (not shown) between the recording data expansion DMA section E2015 and the head control section E2018.

By a controlling operation of the CPU E1001 through the CPUI/F E2001, the head controlling section E2018 performs interfacing with the recording head cartridge H1000 or the scanner M6000 through the head control signal E1021. In addition, based on a head driving timing signal E2049 from an encoder signal control section E2019, the head controlling section E2018 outputs a data expansion timing signal E2050 to the recording data expansion DMA section E2015.

During a printing operation, in accordance with the head driving timing signal E2049, the head controlling section E2018 reads out an expansion recording data (RDHD) E2048 from the column buffer E2017, and outputs the expansion recording data E2048 as a head control signal E1201 to the recording head cartridge H1000.

In the scanner reading mode, incorporated data (WDHD) E2053 input through the head control section E2018 is transferred by a DMA operation to the scanner incorporating buffer E2024 of the DRAM E2005. By a controlling operation by the CPU E1001 through the CPUI/F E2001, a scanner data processing DMA section E2025 reads out incorporating buffer readout data (RDAV) E2054 stored in the scanner incorporating buffer E2024, and writes data (WDAV) E2055 which has been subjected to an averaging operation and the like to the scanner data buffer E2026 of the DRAM E2005.

By a controlling operation by the CPU E1001 through the CPUI/F E2001, a scanner data compression DMA section E2027 reads and compresses processed data (RDYC) E2056 in the scanner data buffer E2026. The compressed data (WDYC) E2057 is written and transferred to the send-out buffer E2028. An encoder signal processing section E2019 receives an encoder signal (ENC), and, in accordance with the mode determined by the controlling operation of the CPU E1001, outputs the head driving timing signal E2049. In addition, the encoder signal processing section E2019 stores in a register information regarding the position and speed of the carriage M4001 obtained from the encoder signal E1020, and supplies this information to the CPU E0051. Based on this information, the CPU E1001 determines various parameters in controlling the CR motor E0001. A CR motor control section E2020 outputs the CR motor control signal E1036 a s a result of the controlling operation by the CPU E1001 through the CPUI/F E2001.

A sensor signal processing section E2022 receives the detection signals output from, for example, the PG sensor E0010, the PE sensor E0007, the ASF sensor E0009, and the GAP sensor E0008, and, based on the mode determined by the controlling operation by the CPU E1001, transmits pieces of sensor information carried by these detection signals to the CPU E1001. In addition, the sensor signal processing section E2022 outputs a sensor detection signal E2052 to an LF/PG motor control section DMA section E2021.

By a controlling operation of the CPU E1001 through the CPUI/F E2001, the LF/PG motor control DMA section 2021 reads out the pulse motor drive table (RDPM) E2051 from the motor control buffer E2023 of the DRAM E2005 in order to output the pulse motor control signal E1033. In addition, depending on the operation mode, the LF/PG motor control DMA section 2021 outputs the pulse motor control signal E1033 so that the sensor detection signals trigger controlling operations.

By a controlling operation of the CPU E1001 through the CPUI/F E2001, a light emitting diode (LED) control section E2030 outputs the LED driving signal E1038.

By a controlling operation of the CPU E1001 through the CPUI/F E2001, a port control section E2029 outputs the head power supply ON signal E1022, the motor power supply ON signal E1023, and the power supply control signal E1024.

Figure 18:
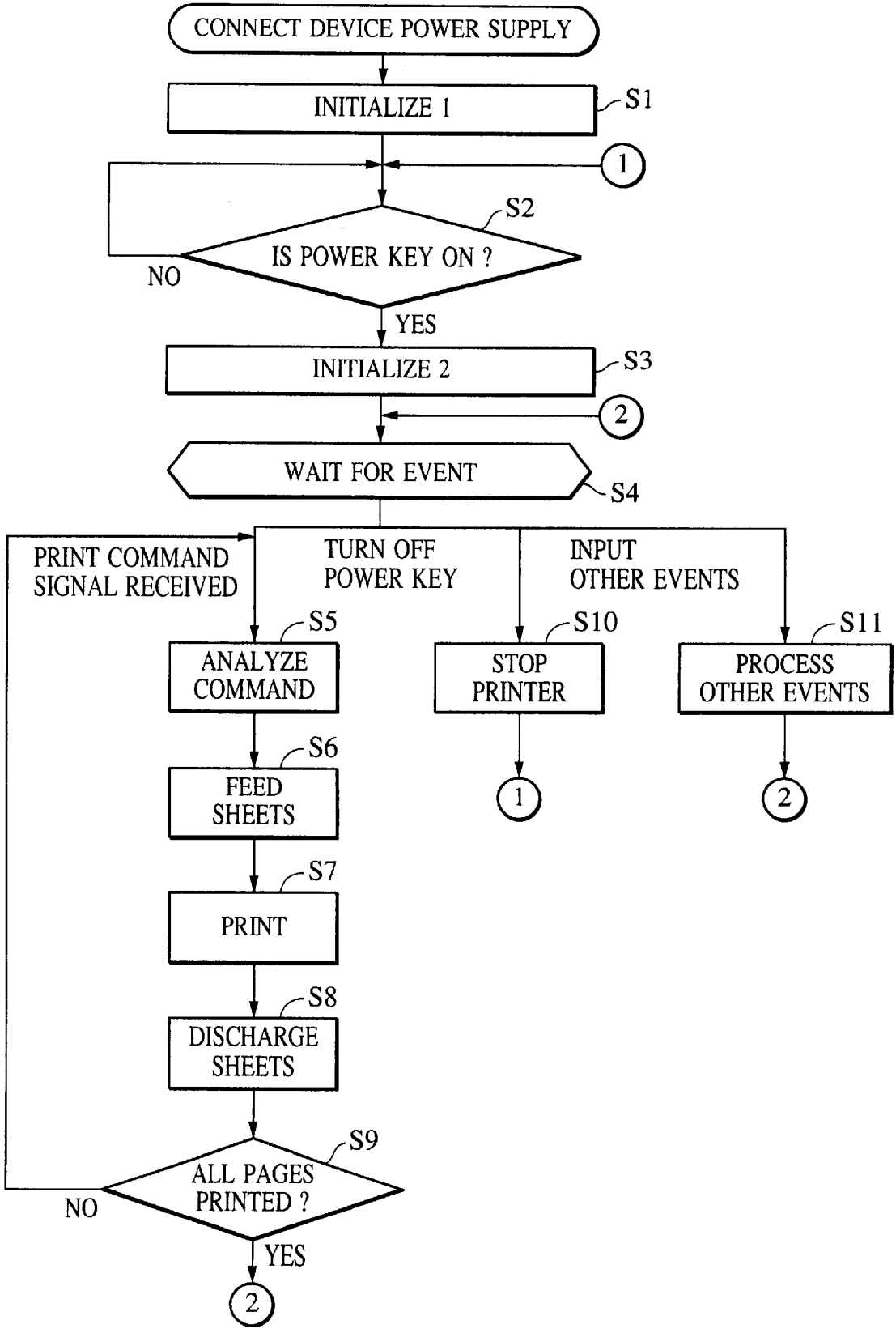
FIG. 18 is a flow chart illustrating the operations carried out in the embodiment of the present invention.

A description of the operation of the inkjet recording device having the above-described structure will now be given with reference to the flowchart shown in FIG. 18.

When an alternating current (AC) power supply is connected to the inkjet recording device, a first initializing operation of the inkjet recording device is carried out in Step S1. In the initializing operation, the electrical circuit system is checked by checking the ROM and RAM of the inkjet recording device to make sure that the inkjet recording device is electrically operating properly.

Then, in Step S2, a determination is made as to whether or not the power key E0018 on the top case M1002 of the body M1000 is turned on. When the power key E0018 has been pressed, the process proceeds to Step S3 to perform a second initializing operation.

In the second initializing operation, the various driving mechanisms and the head system of the inkjet recording device are checked. In other words, a confirmation is made as to whether or not the inkjet recording device can operate properly during the initialization of the various motors and the reading of the head information.

In Step S4, the inkjet recording device waits for an event. More specifically, a command event from an external interface (I/F), a panel key event resulting from the operation by a user, an internal control event, etc., are monitored. When these events are produced, operations which correspond to these events are executed.

For example, when a print command event is received from an external interface in Step S4, the process proceeds to Step S5. When a power key event is produced as a result of the operation by a user in Step S4, the process proceeds to Step S10. When any other event is produced in Step S4, the process proceeds to Step S11.

In Step S5, the print command from the external interface is analyzed, and the specified type of sheet, the size of the sheet, the print quality, the sheet feeding method, and the like, are determined. The data indicating the results of the determination is stored in the RAM E2005 in the inkjet recording device, after which the process proceeds to Step S6.

In Step S6, sheet feeding is started by performing the sheet feeding method specified in Step S5. A sheet is fed to the position where a recording operation is started. Then, the process proceeds to Step S7.

In Step S7, a recording operation is carried out. In the recording operation, record data sent out from the external interface is temporarily stored in a record buffer, and, the CR motor E0001 is driven in order to start the movement of the carriage M4001 in the scanning direction. When the movement of the carriage M4001 is started, the record data stored in the print buffer E2104 is supplied to the recording head H1001 in order to record one line. After the recording of the record data for one line has been completed, the LF motor E0002 is driven in order to rotate the LF roller M3001. The rotation of the LF roller M3001 advances the sheet in the subscanning direction. After the advancing of the sheet, the above-described operations are repeatedly executed. When the recording of data for one page from the external interface is completed, the process proceeds to Step S8.

In Step S8, the LF motor E0002 in order to drive the discharge roller M2003. The sheet feeding is repeatedly carried out until a determination is made that the sheet has been completely sent out from the inkjet recording device. When the sheet feeding is completed, the sheet is completely discharged onto the discharge tray M1004*a*.

In Step S9, a determination is made as to whether or not all of the pages which need to be subjected to printing have been subjected to printing. If there are any pages have not been subjected to printing, the process returns to Step S5, and the Steps S5 to S9 are repeated. When all of the pages which need to be subjected to printing have been subjected to printing, the recording operation ends. Thereafter, the process proceeds to Step S4 in order to wait for the next event.

In Step S10, the operation of the printer is stopped. More specifically, in order to turn off the power supplies of the various motors, the head, etc., the power supplies are set in a state which allows them to be turned off. After the power supplies have been turned off, the process proceeds to Step S4 in order to wait for the next event.

In Step S11, events other than those described above are processed. For example, an operation which corresponds to a recovery command from various panel keys or an external interface, or an operation which corresponds to a recovery command produced internally is carried out. After completing the operation, the process proceeds to Step S4 in order to wait for the next event.

Characteristic Structures

The distinctive features of the above-described basic structure of the present embodiments of the printer in accordance with the present invention will now be given with reference to FIGS. 19 to 25C.

First Embodiment

FIGS. 19 to 24C illustrate a wiper blade and a blade cleaner (that is, a wiper cleaner) used in a first embodiment of the present invention. In the first embodiment, the structure of a driving mechanism of a cap M5001 is partly different from that used in the basic structure. However their basic functions are the same.

Figure 19:
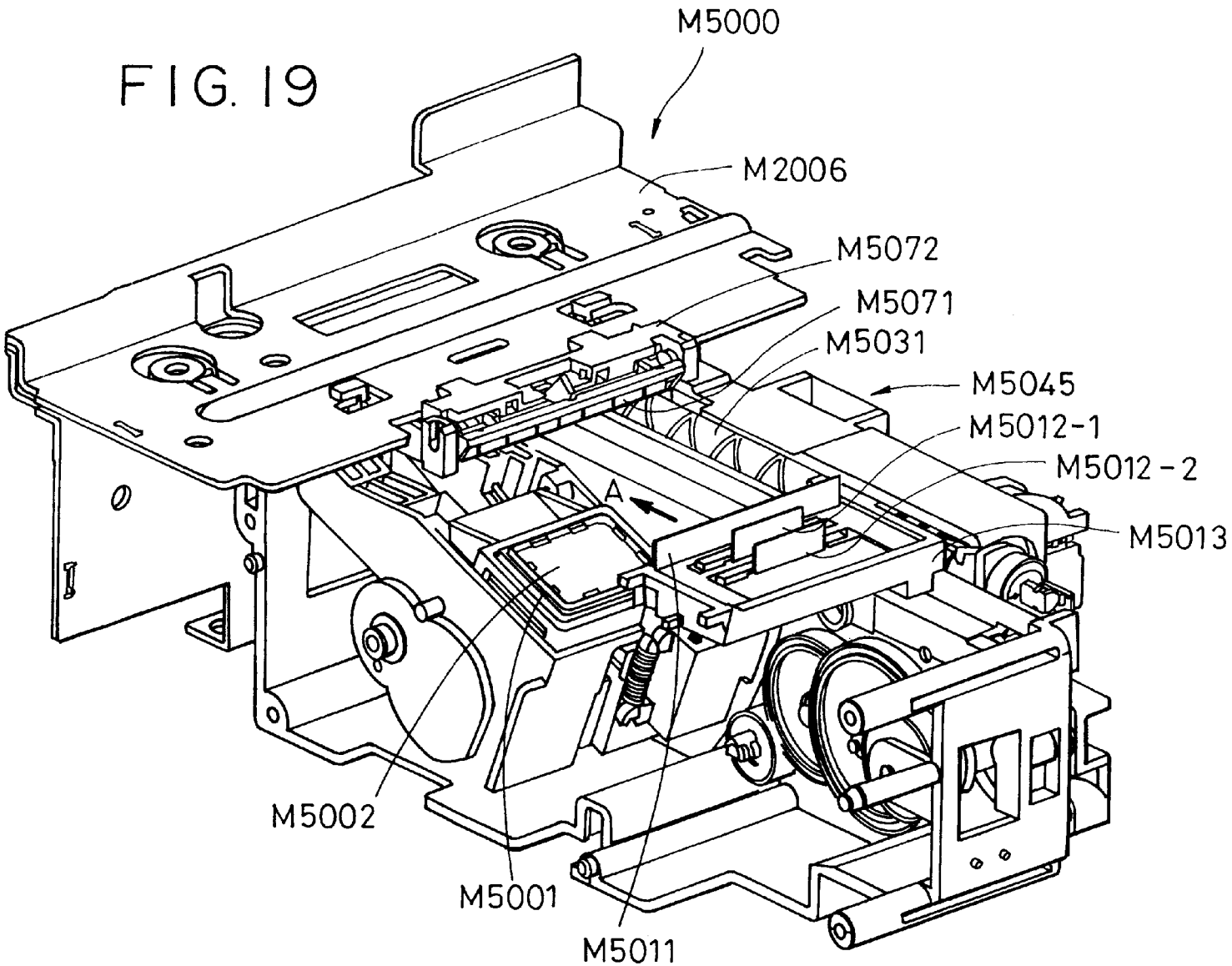
FIG. 19 is a perspective view used to illustrate a structure characteristic of a first embodiment of the present invention, in which a state of one operation of a recovery system unit is shown.

In FIG. 19, wiper blades M5011, M5012-1, and M5012-2 remove any foreign matter, such as ink, stuck on a recording element substrate H1100 of a recording head H1001 by coming into contact with and wiping the recording element substrate H1100. The wiper blades M5011, M5012-1, and M5012-2 are, for example, resilient members such as silicone rubber plates. Foreign matter, such as ink, wiped off from the recording element substrate H1100 sticks onto the wiper blades M5011, M5012-1, and M5012-2.

If the wiper blades M5011, M5012-1, and M5012-2 are brought into contact with the recording element substrate H1100 while foreign matter, such as ink, is stuck on the wiper blades M5011, M5012-1, and M5012-2, the foreign matter is transferred onto the recording element substrate H1100, thereby staining the recording element substrate H1100. This may prevent proper discharge of ink from the recording head H1001.

In order to overcome this problem, a blade cleaner (that is a wiper cleaner) M5071 is provided for removing any foreign matter, such as ink, stuck on the wiper blades M5011, M5012-1, and M5012-2 immediately after the wiper blades M5011, M5012-1, and M5012-2 have wiped the recording element substrate H1100. The blade cleaner M5071 is rotatably supported by a cleaner holder M5072 by shafts M5071A at both ends of the blade cleaner M5071. In other words, the blade cleaner M5071 can rotate in the directions of arrows B and D (see FIGS. 20 and 22) around the horizontal center line 0 passing through the shafts M5071A. The cleaner holder M5072 is mounted to a spur stay M2006.

Figure 20:
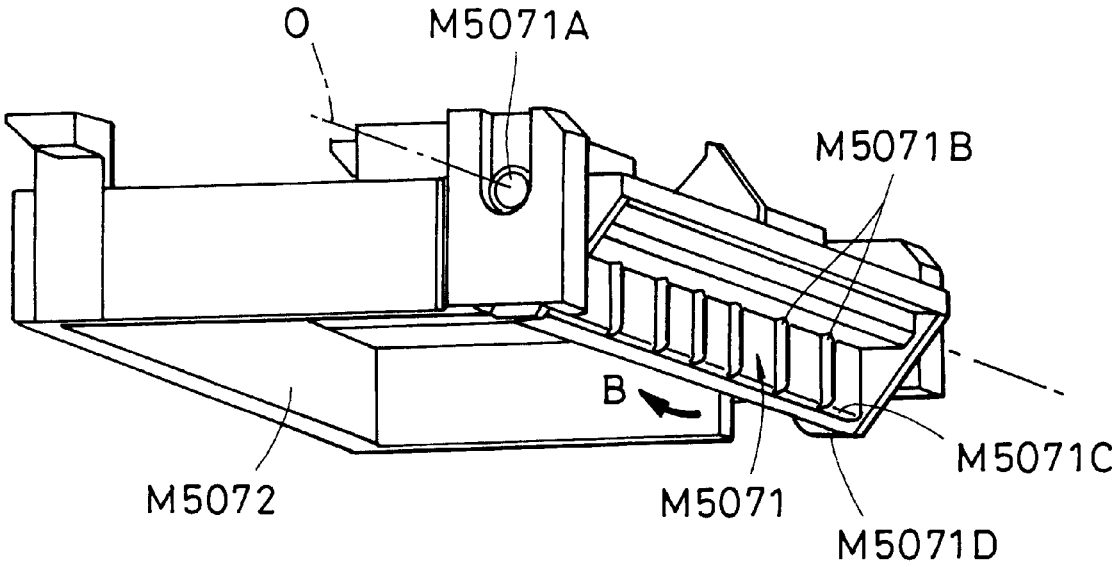
FIG. 20 is a perspective view of a blade cleaner in the state of one operation of the recovery system unit shown in FIG. 19.
Figure 23:
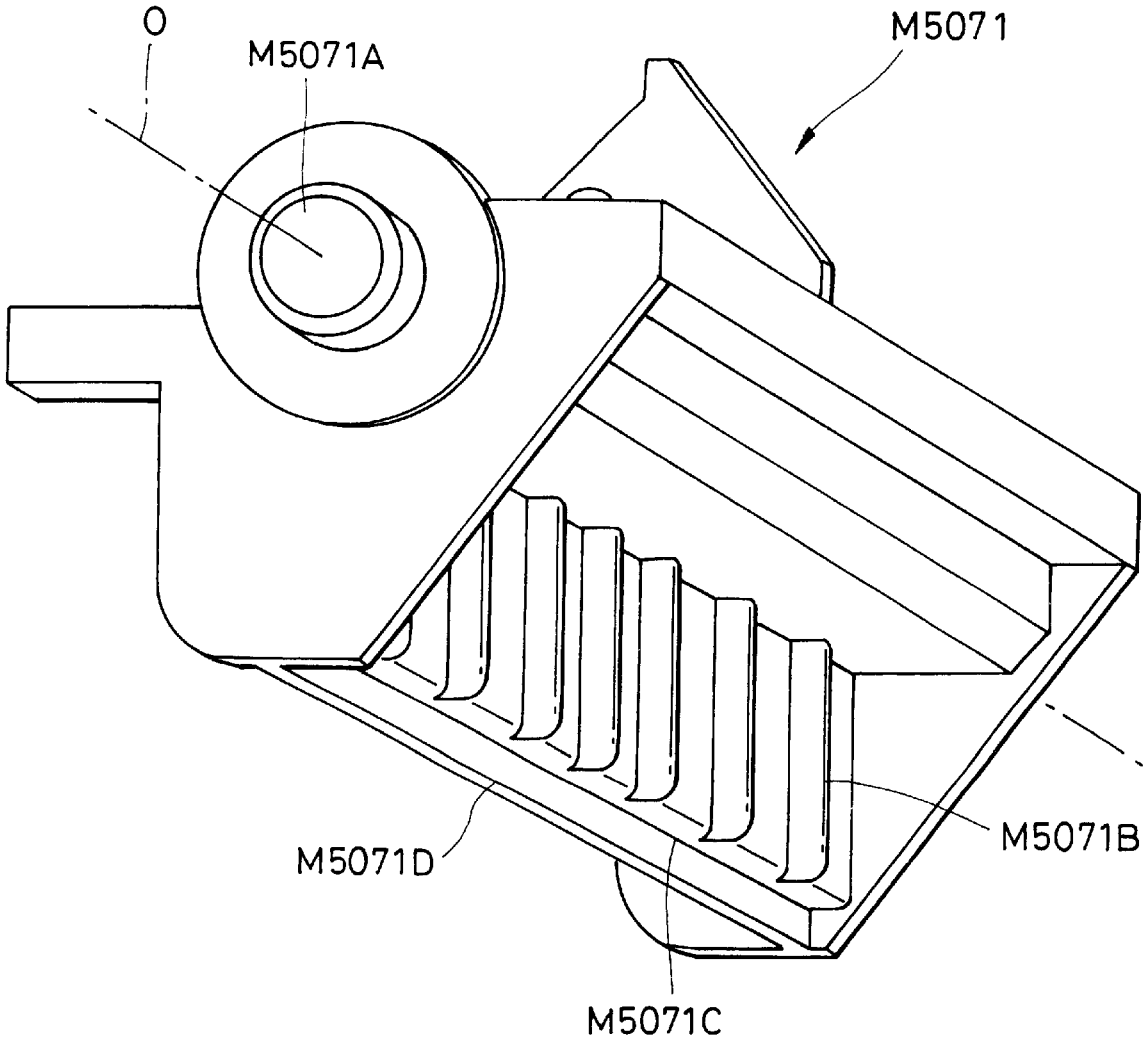
FIG. 23 is an enlarged perspective view of the blade cleaner shown in FIG. 20.

A plurality of ribs 5071B which extend vertically are formed in the right side surface of the blade cleaner M5071 shown in FIG. 20. As shown in FIG. 23, a scraping-off edge section M5071D is formed at the bottom end of the blade cleaner M5071. In addition, as shown in FIG. 23, a canopy M5071C which extends parallel to the scraping-off edge section M5071D is formed approximately 0.5 mm above the edge section 5071D.

Ordinarily, the blade cleaner M5071 is maintained in the posture shown in FIGS. 19 and 20 by its own weight. The position where the blade cleaner M5071 is in the posture shown in FIGS. 19 and 20 is set as the position of limit of rotation in the direction of arrow B. The rotation of the blade cleaner M5071 is restricted so that the blade cleaner M5071 cannot rotate in the direction of arrow B from its posture shown in FIG. 20. Therefore, when the blade holder M5013 moves in the direction of arrow A shown in FIG. 19 as a result of the rotation of a lead screw M5031, the blade cleaner M5071 successively cleans the wiper blades M5011, M5012-1, and M5012-2 as shown in FIGS. 24A, 24B, and 24C, without rotating in the direction of arrow B from its posture shown in FIG. 20.

Figure 24A:
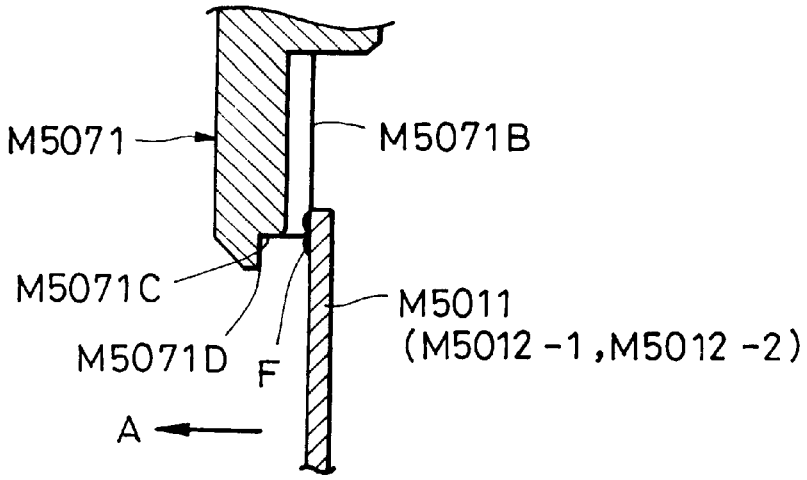
FIGS. 24A, 24B, and 24C are enlarged sectional views of the main portion of the blade cleaner and a wiper blade, and are used to illustrate the operation of the blade cleaner shown in FIG. 19.
Figure 24B:
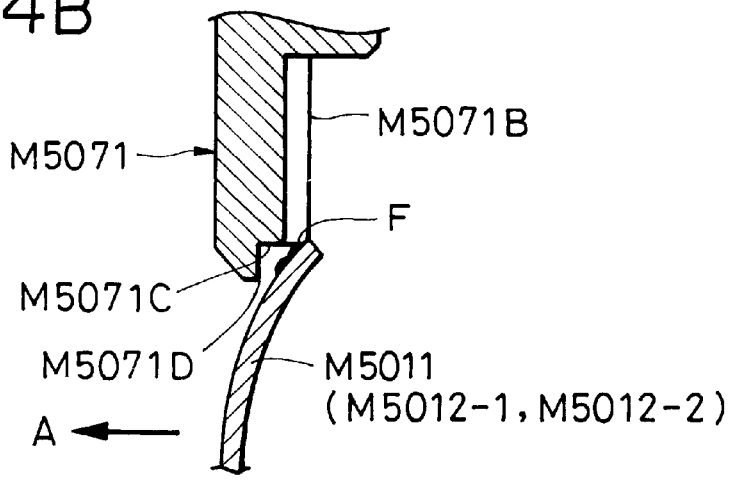
Figure 24C:
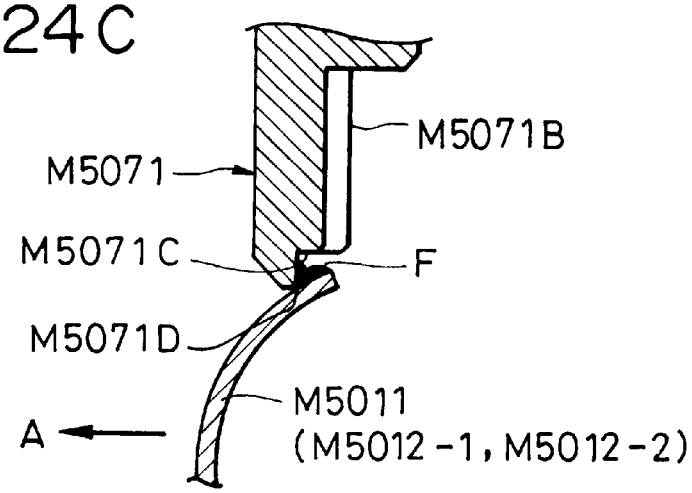

As shown in FIG. 24A, the wiper blade M5011 is in contact with the ribs M5071B of the blade cleaner M5071. Then, as shown in FIG. 24B, the wiper blade M5011 is bent, so that, as shown in FIG. 24C, a portion near an end of the wiper blade M5011 movably contacts the scraping-off edge section M5071D of the blade cleaner M5071 in order to remove any foreign matter F, such as ink, stuck on the wiper blade M5011.

Accordingly, since the wiper blade M5011 is first brought into contact with the ribs M5071B of the blade cleaner M5071, surfaces of the wiper blade M5011 and the blade cleaner M5071 are prevented from immediately come into contact with each other. Therefore, it is possible to prevent the foreign matter F stuck on the wiper blade M5011 from scattering due to the shock produced when the wiper blade M5011 and the blade cleaner M5071 come into contact with each other. At the same time, it is possible to prevent foreign matter F accumulated on the blade cleaner M5071 from sticking onto the wiper blade M5011 again.

Similarly, the wiper blades M5012-1 and M5012-2 are successively cleaned.

Figure 21:
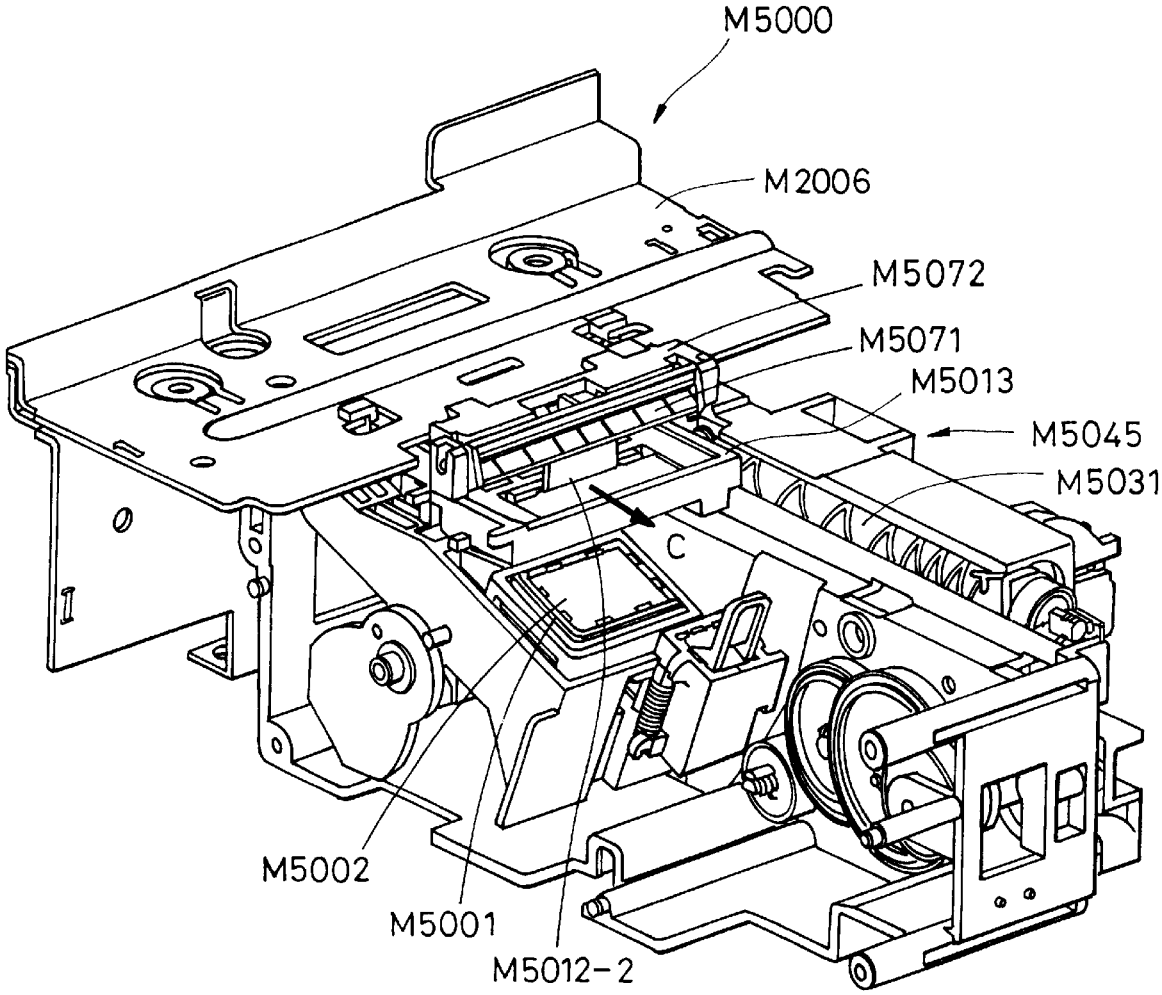
FIG. 21 is a perspective view of a state of another operation of the recovery system unit shown in FIG. 19.

Thereafter, the blade holder M5013 moves in the direction of arrow C shown in FIG. 21 to return to its original position.

Figure 22:
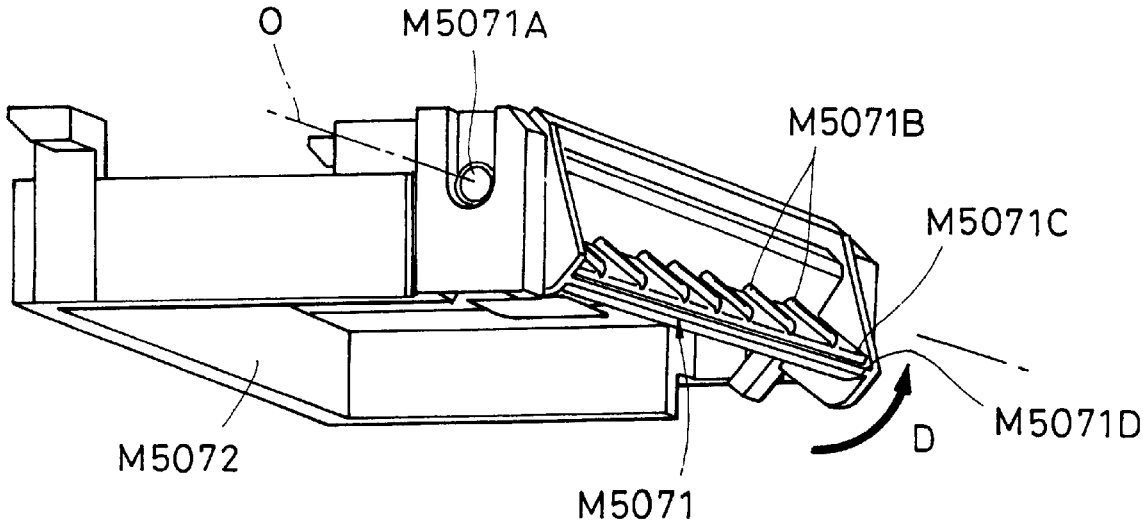
FIG. 22 is a perspective view of the blade cleaner in the state of the operation of the recovery system unit shown in FIG. 21.

The blade cleaner M5071 can rotate in the direction of arrow D from its posture shown in FIG. 20. Therefore, when the wiper blades M5011, M5012-1, and M5012-2 move in the direction of arrow C shown in FIG. 21, the blade cleaner M5071 rotates in the direction of arrow D as shown in FIG. 22. The wiper blades M5011, M5012-1, and M5012-2 move in the direction of arrow C without being bent. Consequently, the scattering of any foreign matter F caused by the bending of the wiper blades M5011, M5012-1, and M5012-2 is prevented from occurring.

By placing the canopy M5071C of the blade cleaner M5071 approximately 0.5 mm above the scraping-off edge section M5071, the amount of spreading in the upward direction of the foreign matter F, such as ink, scraped off by the blade cleaner M5071 is reduced. In other words, the area of the blade cleaner M5071 where the scraped off foreign matter F accumulates is reduced. Therefore, the area where the foreign matter F scraped off by the blade cleaner M5071 can accumulate quickly disappears, causing the foreign matter F to drop and move away from the blade cleaner M5071. As a result, the blade cleaner M5071 is maintained at all times in a state with little staining by the foreign matter F, making it possible to effectively clean the wiper blades M5011, M5012-1, and M5012-2.

Second Embodiment

Figure 25A:
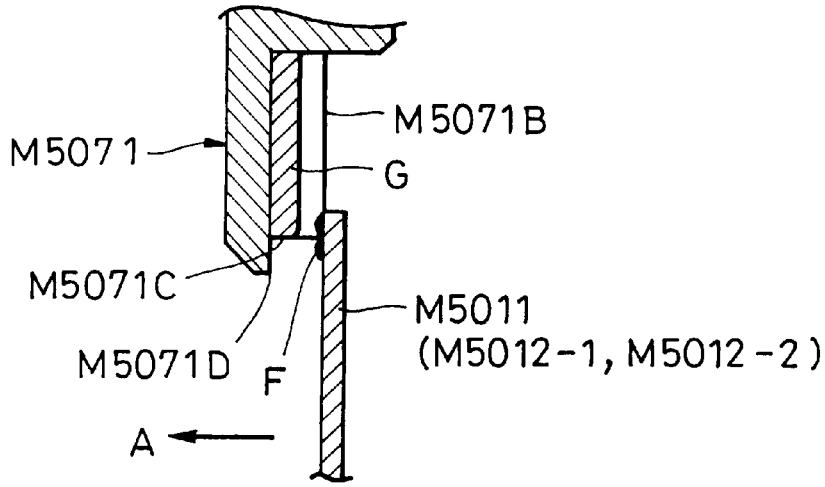
FIGS. 25A, 25B, and 25C are enlarged sectional views of the main portion of a blade cleaner and a wiper blade used in a structure characteristic of a second embodiment of the present invention.
Figure 25B:
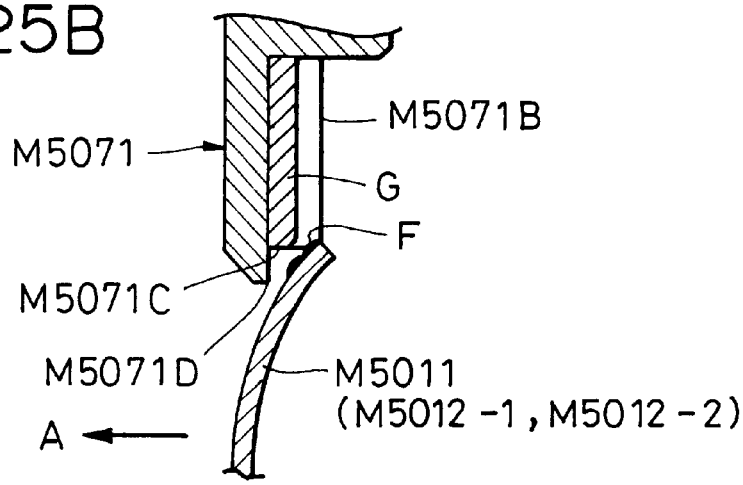
Figure 25C:
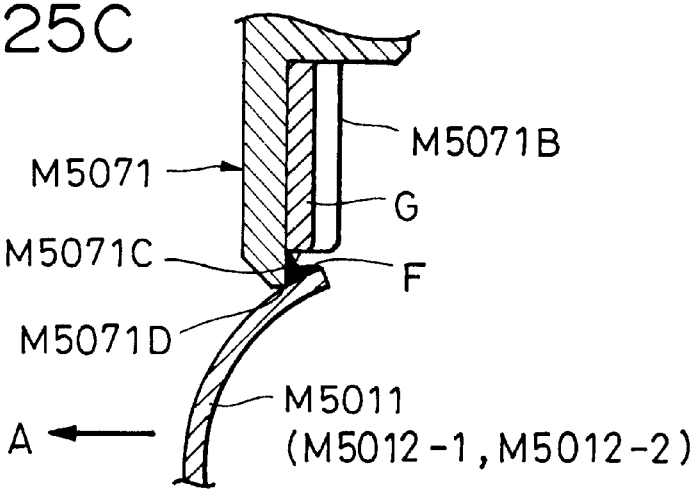
Figure 26A:
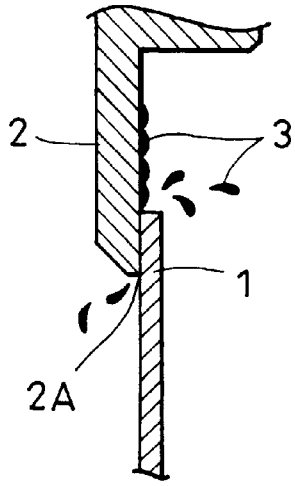
FIG. 26A PRIOR ART
FIGS. 26A, 26B, and 26C are enlarged sectional views of the main portion of a conventional blade cleaner and a conventional wiper blade, and are used to illustrate the operation of the conventional blade cleaner.
Figure 26B:
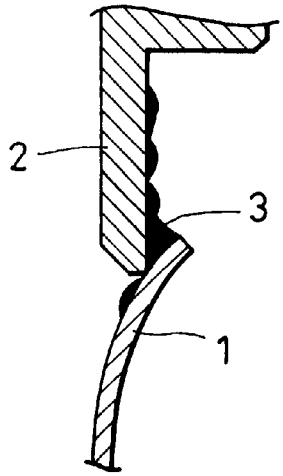
FIG. 26B PRIOR ART
Figure 26C:
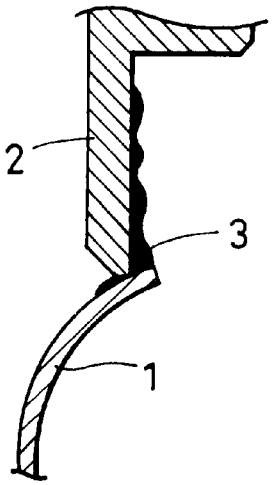
FIG. 26C PRIOR ART

FIGS. 25A, 25B, and 25C illustrate a second embodiment of the present invention.

In this embodiment, an absorbing member G which can absorb ink corresponds to the canopy M5071C of the blade cleaner M5071 used in the first embodiment. The absorbing member G absorbs foreign matter, such as ink, scraped off by a scraping-off edge section M5071D. As a result, the scraping-off edge section M5071D is kept clean.

Others

The ribs M5071B only need to be constructed as contact range limiting means which, when the wiper blades M5011, M5012-1, and M5012-2 start coming into contact with the blade cleaner M5071, limits the range of contact thereof, and allows them to contact each other. Accordingly, as long as this limiting function is provided, means other than ribs may also be used. In addition, as long as the functions of the wiper blades M5011, M5012-1, and M5012-2 are not adversely affected, the contact range limiting means may be formed on the wiper blades M5011, M5012-1, and M5012-2.

The canopy M5071C only needs to be constructed as an accumulating area limiting means for limiting the accumulation area of foreign matter F between it and the scraping-off edge section M5071D. Accordingly, as long as the limiting function is provided, means other than a canopy may also be used. The distance between the canopy M5071C and the scraping-off edge section M5071D opposing each other is preferably not more than 1 mm, and is more preferably approximately 0.5 mm.

In a preferred form of the present invention, heat energy generated by an electrothermal energy converter is used to boil a liquid film to produce bubbles.

As can be understood from the foregoing description, in starting to make the wiper blades and the wiper cleaner contact each other, they are partly brought into contact with each other as a result of limiting the range of contact of the wiper blades and the wiper cleaner, making it possible to prevent scattering of foreign matter, such as ink, around the wiper blades and the wiper cleaner.

By limiting the area of accumulation of foreign matter scraped off from the wiper blades, the foreign matter can be removed early by making it drop from the wiper cleaner. Therefore, the amount of staining of the wiper cleaner by the accumulation of foreign matter can be reduced, making it possible to maintain the cleaning effect of the wiper blades.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A cleaning device for an inkjet recording head for wiping a discharge portion of the inkjet recording head which discharges ink by a resilient wiper blade, and for cleaning the wiper blade by a wiper cleaner, the cleaning device comprising:

moving means for moving the wiper blade and the wiper cleaner relative to each other so that the wiper blade and the wiper cleaner come into contact with each other; and a plurality of ribs in a row provided on said wiper cleaner, wherein said plurality of ribs prevent said wiper blade from immediately coming into surface contact with said wiper cleaner.

2. A cleaning device for an inkjet recording head according to claim 1, wherein said plurality of ribs are provided at a position where said ribs comes into contact with a portion near an end of the wiper blade.

3. A cleaning device for an inkjet recording head according to claim 1, wherein the discharge portion of the inkjet recording head wiped by the wiper blade is a surface where an ink ejection opening is formed.

4. A cleaning device for an inkjet recording head according to claim 1, further comprising an edge section formed on an end of the wiper cleaner so as to extend in a longitudinal direction of the wiper blade.

5. A cleaning device for an inkjet recording head according to claim 1, further comprising means which restricts a position of the wiper cleaner so that the wiper cleaner contacts the wiper blade when the wiper blade and the wiper cleaner move relative to each other in one direction, and which causes the wiper cleaner to move away from the position where the wiper cleaner contacts the wiper blade when the wiper blade and the wiper cleaner move relative to each other in the other direction.

6. A cleaning device for an inkjet recording head according to claim 1, further comprising an accumulation area limiting means, disposed on the wiper cleaner, for limiting the accumulation area of foreign matter scraped off from the wiper blade.

7. A cleaning device for an inkjet recording head according to claim 6, further comprising an edge section formed on an end of the wiper cleaner so as to extend in a longitudinal direction of the wiper blade, wherein the accumulation area limiting means is a canopy which extends substantially parallel to the edge section.

8. A cleaning device for an inkjet recording head according to claim 7, wherein the canopy and the edge section oppose each other at a distance of not more than 1 mm.

9. A cleaning device for an inkjet recording head according to claim 7, wherein the canopy is an absorbing member for absorbing ink.

10. A cleaning device for an inkjet recording head according to any one of claims 1 and 2 to 9, wherein the inkjet recording head includes an electrothermal converting member for generating heat energy using ink discharge energy.

11. An inkjet recording device for recording an image on a record medium using an inkjet recording head which discharges ink, the inkjet recording device comprising:

the cleaning device for cleaning a portion of the inkjet recording head of any one of claims 1, 2 to 9 and 10.

12. An inkjet recording device according to claim 11, further comprising first moving means for moving the inkjet recording head and the record medium relative to each other along a main scanning direction, and second moving means for moving the inkjet recording head and the record medium relative to each other along a subscanning direction perpendicular to the main scanning direction.

* * * * *

UNITED STATES PATENT AND TRADEMARK OFFICE

CERTIFICATE OF CORRECTION

PATENT NO. : 6,565,188 B1
DATED : May 20, 2003
INVENTOR(S) : Saito

It is certified that error appears in the above-identified patent and that said Letters Patent is hereby corrected as shown below:

Column 3,
Line 14, “blade,” should read -- blade 1. --.

Column 5,
Line 7, “commonly used” should read -- commonly-used --.

Column 6,
Line 25, “now” should read -- now be --.

Column 23,
Line 14, “E2028. An” should read -- E2028. ¶ An --;
Line 22, “E0051.” should read -- E1001. --; and
Line 25, “a s a” should read -- as a --.

Column 24,
Line 54, “pages” should read -- pages that --.

Column 25,
Line 41, “is a” should read -- is, a --.

Column 26,
Line 19, “come” should read -- coming --.

Column 27,
Line 57, “prevent” should read -- prevents --.

Column 28,
Line 5, “comes” should read -- come --;
Line 41, “claims 1 and 2 to 9,” should read -- claims 1 to 9, --; and

UNITED STATES PATENT AND TRADEMARK OFFICE

CERTIFICATE OF CORRECTION

PATENT NO. : 6,565,188 B1
DATED : May 20, 2003
INVENTOR(S) : Saito

It is certified that error appears in the above-identified patent and that said Letters Patent is hereby corrected as shown below:

Column 28 (cont'd),
Line 48, "claims 1, 2 to 9 and 10." should read -- claims 1 to 10. --.

Signed and Sealed this

Twentieth Day of January, 2004

JON W. DUDAS
*Acting Director of the United States Patent and Trademark Office*